US008257166B2

(12) United States Patent
Kido

(10) Patent No.: US 8,257,166 B2
(45) Date of Patent: Sep. 4, 2012

(54) DICE GAMING MACHINE

(75) Inventor: Katsuhiro Kido, Tokyo (JP)

(73) Assignee: Universal Entertainment Corporation, Koto-Ku, Tokyo (JP)

( * ) Notice: Subject to any disclaimer, the term of this patent is extended or adjusted under 35 U.S.C. 154(b) by 257 days.

(21) Appl. No.: 12/554,255

(22) Filed: Sep. 4, 2009

(65) Prior Publication Data

US 2010/0069142 A1 Mar. 18, 2010

Related U.S. Application Data

(60) Provisional application No. 61/097,610, filed on Sep. 17, 2008, provisional application No. 61/097,615, filed on Sep. 17, 2008.

(51) Int. Cl.
*A63F 9/24* (2006.01)
*A63F 9/04* (2006.01)

(52) U.S. Cl. ..... 463/22; 463/25; 273/146

(58) Field of Classification Search ..... 463/22, 463/25, 2; 273/146
See application file for complete search history.

(56) References Cited

U.S. PATENT DOCUMENTS

| | | | | |
|---|---|---|---|---|
| 5,413,351 | A * | 5/1995 | Franklin | 273/274 |
| 6,520,503 | B1 * | 2/2003 | Porto | 273/274 |
| 7,571,910 | B1 * | 8/2009 | Launzel | 273/142 HA |
| 7,950,995 | B2 * | 5/2011 | Schugar et al. | 463/20 |
| 2002/0090988 | A1 * | 7/2002 | Frost et al. | 463/17 |
| 2002/0160827 | A1 * | 10/2002 | Slomiany et al. | 463/16 |
| 2004/0077398 | A1 * | 4/2004 | Jarvis et al. | 463/17 |
| 2004/0195763 | A1 * | 10/2004 | Perrie et al. | 273/138.1 |
| 2005/0239537 | A1 * | 10/2005 | Ogiwara | 463/17 |
| 2005/0285336 | A1 * | 12/2005 | Ilievski | 273/143 R |
| 2006/0033281 | A1 * | 2/2006 | Wong | 273/292 |
| 2006/0237905 | A1 * | 10/2006 | Nicely et al. | 273/274 |
| 2007/0015567 | A1 * | 1/2007 | Schugar et al. | 463/22 |
| 2007/0026947 | A1 | 2/2007 | Chun | |
| 2008/0064467 | A1 * | 3/2008 | Reiner | 463/16 |
| 2008/0096642 | A1 * | 4/2008 | Yoshizawa | 463/22 |
| 2008/0139280 | A1 * | 6/2008 | Inamura | 463/17 |
| 2008/0176643 | A1 * | 7/2008 | Phillips et al. | 463/25 |
| 2009/0181746 | A1 * | 7/2009 | Nagano | 463/17 |
| 2009/0181747 | A1 * | 7/2009 | Nagano | 463/17 |
| 2009/0181748 | A1 * | 7/2009 | Nagano | 463/17 |
| 2010/0130280 | A1 * | 5/2010 | Arezina et al. | 463/20 |

OTHER PUBLICATIONS

"Sic Bo Appendix" retreived from http://wizardofodds.com/sicbo/appendix.html, published on Feb. 5, 2007, pp. 1 to 3.*

"Roulette Rules" published by Play-in-casino.com on or before Sep. 2, 2005 and retrieved from <URL: http://replay.waybackmachine.org/20050902181121/http://www.play-in-casino.com/roulette.htm> on Apr. 12, 2011, 2 pages.*

* cited by examiner

*Primary Examiner* — Dmitry Suhol
*Assistant Examiner* — Jason Skaarup
(74) *Attorney, Agent, or Firm* — Lexyoume IP Meister, PLLC

(57) ABSTRACT

The dice gaming machine accepts a bet on a bet area and a bet on an intermediate area between/among a plurality of bet areas. After ending the bet acceptance, it starts rolling dice. After the rolling of the dice has been stopped, the dice gaming machine identifies a winning bet area based on the dice rolling result. A payout amount for each terminal is calculated based on the identified winning bet area, the bet area or the intermediate area on which the bet is accepted, and a payout magnification ratio set for the bet area or the intermediate area.

6 Claims, 24 Drawing Sheets

DICE GAMING MACHINE

CROSS-REFERENCE TO RELATED APPLICATIONS

This application is based upon and claims a priority from the U.S. provisional Patent Application No. 61/097,610 filed on Sep. 17, 2008, the U.S. provisional Patent Application No. 61/097,615 filed on Sep. 17, 2008, the entire contents thereof are incorporated herein by reference.

BACKGROUND

1. Technical Field

One or more aspects of the present invention relate to a dice gaming machine for carrying out a game wherein bets are placed on spots on a plurality of dice.

2. Description of Related Art

Conventionally, dice gaming machines are installed in game arcades. In the dice gaming machines, a game is carried out using a plurality of dice. For instance, one game which is played in such dice gaming machines is the so-called "Sic Bo" game.

In the dice game represented by "Sic Bo", a player bets a gaming value with respect to the spots on a plurality of dice. Once the rolled dice have stopped, the player can win a prize (for instance, payout) based on the spots on the stopped dice.

In the above dice game, there are provided a plurality of bet areas on a betting board on which players can bet a gaming value. Conventionally, when a player bets on a plurality of bet areas at a same lottery, the player has to make an operation of betting a gaming value on each of the plurality of bet areas of bet target.

The present invention provides a novel dice gaming machine which can accept a bet of a gaming value on an intermediate area between/among bet areas, thus improving the convenience of players and allowing players to enjoy much wider variety of gaming elements.

Also, in the above dice game, a plurality of bet areas provided on the betting board are categorized into a plurality of groups according to the types of winning conditions based on the spots on the stopped dice. For instance, there is a bet area whose winning condition is that the total of spots on dice coincides with a predetermined number or a bet area whose winning condition is that the spots on dice coincide with predetermined spots. However, in the conventional dice gaming machines, the types of winning conditions as mentioned above are not taken into consideration at the layout of the bet areas on the betting board. Accordingly, it has been difficult for a novice player to grasp how the bet areas associated with the same type of winning condition are positioned on the betting board. Accordingly, a player can't execute a bet operation quickly and accurately.

Other object of the present invention is to provide a novel dice gaming machine in which a plurality of bet areas making up a betting board are positioned so as to be make the bet areas associated with the same type of winning condition in a matrix state, as well as a bet of a gaming value on an intermediate area between/among bet areas can be accepted, thus improving the convenience of players and allowing players to enjoy much wider variety of gaming elements.

SUMMARY

Therefore, in order to achieve the above object, according to a dice gaming machine of the invention encompassing one or more aspects thereof, there is provided a dice gaming machine. A dice gaming machine comprises a dice box in which a plurality of dice are rolled and stopped; and a plurality of terminals each having a betting board having a plurality of bet areas each associated with a winning condition based on spots on the plurality of dice stopped and with a predetermined payout magnification ratio, the plurality of terminals each accepting an input by a player; and a processor. The processor accepts a bet of a gaming value on an intermediate area between/among the plurality of bet areas at any of the plurality of the terminals. The processor rolls and stopping the plurality of dice. The processor identifies a bet area which satisfies the winning condition based on spots on the plurality of dice stopped. The processor awards a prize based on an amount of the gaming value bet at the intermediate area bordering the bet area identified and a payout magnification ratio set for the intermediate area. Thereby, new locations on which a bet can be accepted can thus be created on the intermediate areas between/among bet areas. Accordingly, the dice gaming machine can improve the convenience of players while allowing players to enjoy much wider variety of gaming elements.

A dice gaming machine related to one or more aspect of invention has a constitution described hereinafter. More specifically, the dice gaming machine comprises a dice box in which a plurality of dice are rolled and stopped; a plurality of terminals each having a betting board having a plurality of bet areas each associated with a winning condition based on spots on the plurality of dice stopped and with a predetermined payout magnification ratio, the plurality of terminals each accepting an input by a player; and a processor. The processor positions the plurality of bet areas making up the betting board of each of the plurality of terminals so that a plurality of bet areas each associated with a same type of winning condition are in a matrix state. The processor accepts a bet of a gaming value on one of intermediate areas between or among the plurality of bet areas each associated with the same type of winning condition at any of the plurality of the terminals. The processor rolls and stopping the plurality of dice. The processor identifies a bet area which satisfies the winning condition based on spots on the plurality of dice stopped. The processor awards a prize based on an amount of the gaming value bet at an intermediate area bordering the bet area identified and a payout magnification ratio set for the intermediate area. Thereby, the dice gaming machine enables a player to grasp how the bet areas associated with the same type of winning condition are positioned on the betting board. Accordingly, the dice gaming machine enables a player to execute a bet operation quickly and accurately. And the dice gaming machine can allow players to enjoy much wider variety of gaming elements.

A dice gaming machine related to one or more aspect of invention has a constitution described hereinafter. More specifically, the dice gaming machine comprising a dice box in which a plurality of dice are rolled and stopped; a plurality of terminals each having a betting board having a plurality of bet areas each associated with a winning condition based on spots on the plurality of dice stopped and with a predetermined payout magnification ratio, the plurality of terminals each accepting an input by a player; an operation unit installed in each of the plurality of terminals; and a processor. The processor changes a position pattern of the plurality of bet areas making up the betting board of each of the plurality of terminals, between a first position pattern in which a plurality of bet areas each associated with a same type of winning condition are in a matrix state, and a second position pattern different from the first position pattern. The processor accepts a bet of a gaming value on one of intermediate areas between or among the plurality of bet areas each associated with the same type of winning condition at any of the plurality of the terminals. The processor rolls and stopping the plurality of dice. The processor identifies a bet area which satisfies the winning condition based on spots on the plurality of dice stopped. The processor awards a prize based on an amount of the gaming value bet at an intermediate area bordering the bet area currently identified and a payout magnification ratio set for the intermediate area. Thereby, the dice gaming machine enables a player to grasp how the bet areas associated with the same type of winning condition are positioned on the betting board. And it allows players want to play by using the layout of conventional bet areas to a desired betting board. Accordingly, it enables a player to execute a bet operation quickly and accurately. And it can allow players to enjoy much wider variety of gaming elements.

One or more aspects of the present invention as described above may be sufficiently grasped by reading the following detailed description in connection with the accompanying drawings. However, the purpose of the drawings is solely for exemplification and it should be clearly understood that they are not meant to limit the scope of the present invention.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention.

DETAILED DESCRIPTION

Figure 1:
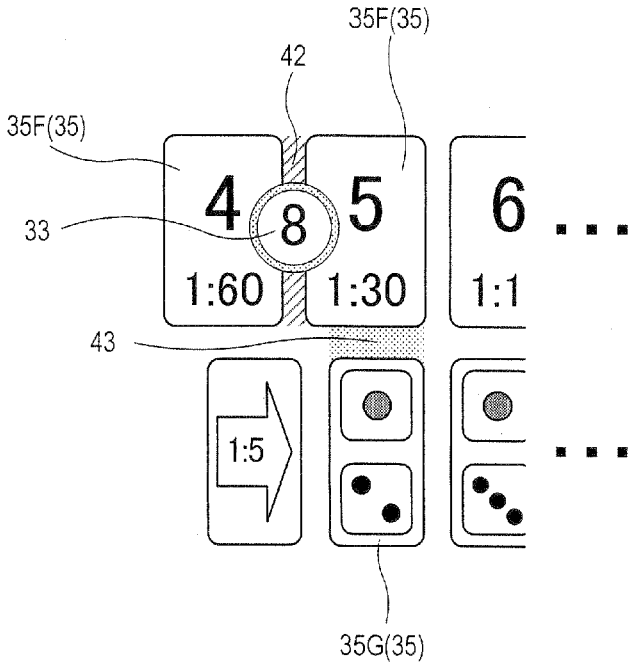
FIG. 1 is an exemplary diagram showing the characteristics of the dice gaming machine according to the first embodiment of the present invention.

The various aspects summarized previously may be embodied in various forms. The following description shows by way of illustration of various combinations and configurations in which the aspects may be practiced. It is understood that the described aspects and/or embodiments are merely examples, and that other aspects and/or embodiments may be utilized and structural and functional modifications may be made, without departing from the scope of the present disclosure.

It is noted that various connections are set forth between items in the following description. It is noted that these connections in general and, unless specified otherwise, may be direct or indirect and that this specification is not intended to be limiting in this respect.

A dice gaming machine according to one or more aspects of the invention will be described in detail with reference to the drawings based on an embodiment embodying one or more aspects of the invention. However, it is appreciated that one or more aspects of the present invention may be embodied in distributable (via CD and the like) or downloadable software games, console games, and the like. In this regard, the dice gaming machine may be a virtual dice gaming machine that is displayed on a multi-purpose computer and/or dedicated kiosk. Aspects of the invention are described by way of hardware elements. However, it is appreciated that these elements may also be software modules that are executable in a computer. The software modules may be stored on a computer readable medium, including but not limited to a USB drive, CD, DVD, computer-readable memory, tape, diskette, floppy disk, and the like. For instance, aspects of the invention may be embodied in a JAVA-based application or the like that runs in a processor or processors. Further, the terms "CPU", "processor", and "controller" are inclusive by nature, including at least one of hardware, software, or firmware. These terms may include a portion of a processing unit in a computer (for instance, in multiple core processing units), multiple cores, a functional processor (as running virtually on at least one of processor or server, which may be local or remote). Further, in network-based gaming systems, the processor may include only a local processor, only a remote server, or a combination of a local processor and a remote server.

It is contemplated that one or more aspects of the invention may be implemented as computer executable instructions on a computer readable medium such as a non-volatile memory, a magnetic or optical disc. Further, one or more aspects of the invention may be implemented with a carrier signal in the form of, for instance, an audio-frequency, radio-frequency, or optical carrier wave.

Hereinafter, the dice gaming machine according to the invention will now be described in detail in first and second embodiments relating to a dice gaming machine, while referring to the drawings.

[First Embodiment]

Here, characteristics of a dice gaming machine 1 will next be described. FIG. 1 is an exemplary view showing characteristics of a dice gaming machine 1 according to the first embodiment.

A dice game which is called "Sic Bo" is played in the dice gaming machine 1. In "Sic-Bo", three dice 40 are rolled. Players predict the result of dice rolling (specifically, the spots on the three dice 40). Also, the players bet gaming values on a betting board 30 based on their prediction.

Here, the betting board 30 is made up of a plurality of bet areas 35 (refer to FIG. 1, etc.). Each bet area 35 is associated with a winning condition and a payout magnification ratio. The winning condition is a condition defined by spot(s) on some or all of the three dice 40. If the spots on the rolled dice 40 satisfy the winning condition, the player who placed a bet on this bet area 35 wins a prize. The payout magnification ratio is used for determining the contents of the prize which is thus awarded. More specifically, the payout magnification ratio defines the magnification ratio of the prize (payout amount) to be awarded with respect to a unit gaming value (specifically, one credit) thus bet. Specifically, players bet gaming values with respect to a bet area 35 corresponding to their prediction as described above.

If the spots on the rolled dice 40 satisfy the winning condition defined for the bet area that is placed a bet by the player, the player wins a prize. The prize in this case is determined by multiplying the amount of gaming value bet by the player by the payout magnification ratio of the bet area 35 in question.

Here, the dice gaming machine 1 according to the first embodiment has a special feature of accepting a bet on an intermediate area 42 located between/among a plurality of bet areas 35. When a player makes a bet on the intermediate area 42, if any bet area 35 from amongst the plurality of bet areas 35 forming the intermediate area 42 satisfies a winning condition, a prize is awarded to the player.

At the same time an intermediate area 42 between/among bet areas 35 has a predetermined payout magnification ratio thereat (hereinafter referred to as an intermediate area payout magnification ratio) based on the magnification ratio of each of the bet areas 35 forming the intermediate area 42. If any bet area 35 from amongst the plurality of bet areas 35 forming the intermediate area 42 satisfies a winning condition, an amount, which is obtained through multiplying the amount of a gaming value being bet on the intermediate area 42 by the intermediate area payout magnification ratio which is set previously, is paid out as a prize.

Figure 2:
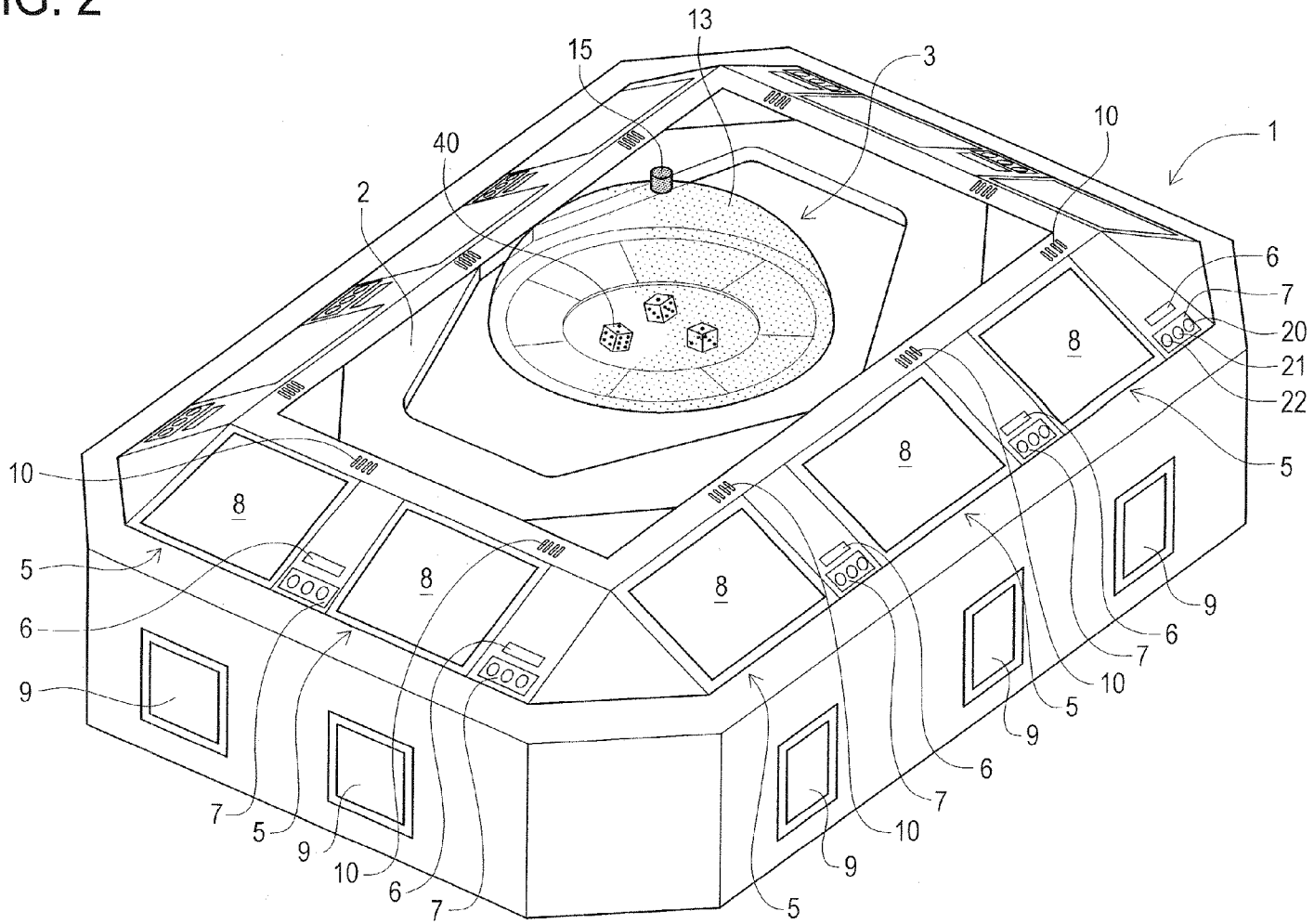
FIG. 2 is a perspective view showing an outer appearance of the dice gaming machine according to the first embodiment of the present invention.

Next, a schematic configuration of the dice gaming machine 1 will be described in detail while referring to the drawings. FIG. 2 is a schematic diagram showing an outer appearance of the dice gaming machine 1 according to the first embodiment.

As shown in FIG. 2, the dice gaming machine 1 according to the first embodiment has a cabinet 2, a dice rolling device 3 and a plurality of terminals 5 (in the first embodiment, ten terminals). The cabinet 2 makes up the main part of the dice gaming machine 1. The cabinet 2 houses electrical components and mechanical components such as a main control unit 50 and the like as will be described later.

The dice rolling device 3 is installed at a central portion on an upper face of the cabinet 2. The dice rolling device 3 has a dice box. The dice box houses three dice 40 therein. The three dice 40 are rolled inside the dice box and are then stopped. The configuration of the dice rolling device 3 will be described in detail later.

The terminals 5 are installed at the periphery of the dice rolling device 3. The terminals 5 each have a liquid crystal display 8. The terminals 5 are used in a player's operation with respect to the dice game (e.g., Sic Bo) played in the dice gaming machine 1. Specifically, players enter the dice game played in the dice gaming machine 1 by using the terminals 5.

The terminals 5 each have a medal acceptance device 6, a control panel 7 and a liquid crystal display 8. The medal acceptance device 6 accepts medals, an exemplary type of gaming value, inserted by the player. Specifically, in the case of playing the dice game, the player inserts medals, an exemplary type of gaming value, in the medal acceptance device 6. The gaming values thus inserted are stored as credit. The player places a bet onto a bet area 35 using such credit.

The control panel 7 is installed at a lower side of the medal acceptance device 6. This control panel 7 has a plurality of operation buttons. More specifically, the control panel 7 also has a BET determination button 20, a CASHOUT button 21 and a HELP button 22.

The BET determination button 20 is operated by the player to determine a bet operation. Specifically, the player operates the BET determination button 20 to determine a bet area 35 or an intermediate area 42 between/among a plurality of bet areas 35 (hereinafter referred to as "bet area 35, etc." including a bet area 35 and an intermediate area 42) which will be the bet target and also to determine the amount of gaming values to be bet with respect to the bet area 35, etc. (hereinafter referred to as bet amount).

The CASHOUT button 21 is operated by the player to request payout of the credits he/she possesses. When this CASHOUT button 21 is operated, medals are paid out from a cashout port 9 in accordance with the number of credits that the player possesses.

The HELP button 22 is operated in case the operation method and the rules of the game are unclear. When the HELP button 22 is operated, the dice gaming machine 1 displays a HELP screen containing explanations with respect to the game operation method and the like onto the liquid crystal display 8.

The liquid crystal display 8 is a display device for displaying information with respect to the dice game. When the dice game is started, each liquid crystal display 8 displays an image of the betting board 30. The touch panel 25 is arranged at a front face of the liquid crystal display 8 in each terminal 5. Accordingly, the player carries out a bet operation with respect to the bet area 35 using this touch panel 25.

Each terminal 5 has a cash out port 9 and a speaker 10. The cashout port 9 is arranged at a lower side of the liquid crystal display 8. This cash out port 9 serves to output medals. For instance, once the CASHOUT button 21 is operated, a number of medals corresponding to the credits the player possesses are paid out to the cashout port 9. Speaker 10 is installed at a right upper side of the liquid crystal display 8. The speaker 10 outputs sounds based on the progress of the game.

Next, the dice rolling device 3 installed in the dice gaming machine 1 will be described in detail while referring to the drawings.

As shown in FIG. 2, the dice rolling device 3 is installed at an upper face of the cabinet 2. The dice rolling device 3 houses three dice 40 therein. The three dice 40 are rolled inside the dice rolling device 3 by controlling the operation of the dice rolling motor 12 as will be described later. The rolled dice 40 are then stopped on a dice rolling board 11. The dice rolling device 3 is installed at a central portion of the cabinet 2. Accordingly, players who are seated at the terminals 5 can see the dice 40 as they are being rolled inside the dice rolling device 3 and the spots on the dice 40 after these are stopped inside the dice rolling device 3.

Figure 3:
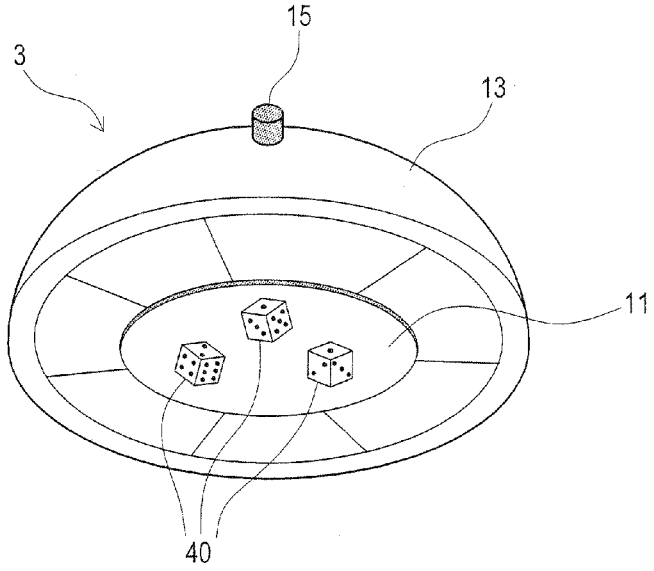
FIG. 3 is a view showing an outer appearance of a dice rolling device according to the first embodiment of the present invention.
Figure 4:
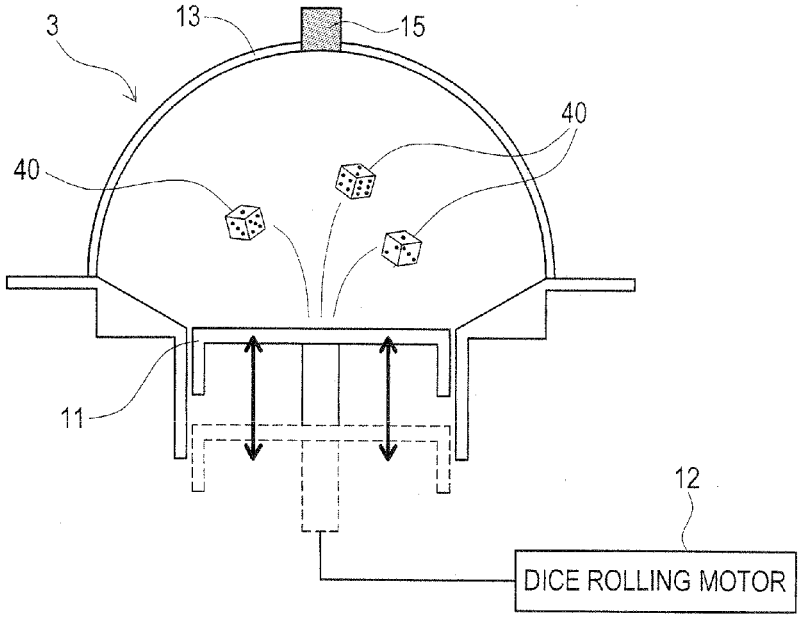
FIG. 4 is an exemplary diagram relating to an operation of the dice rolling device according to the first embodiment of the present invention.

As shown in FIG. 3 and FIG. 4, the dice rolling device 3 has a dice rolling board 11, a dice rolling motor 12, a cover member 13 and a rolling result detection unit 15. The dice rolling board 11 moves up and down within a predetermined range inside the dice rolling device 3 (refer to FIG. 4). The dice rolling board 11 is connected to the dice rolling motor 12. Specifically, the dice rolling board 11 moves up and down within the predetermined range based on driving and control of the dice rolling motor 12.

As shown in FIG. 4, in case of rolling the dice 40, the dice rolling motor 12 causes the dice rolling board 11 to move upwards at a certain speed or faster. Once the dice rolling board 11 moves over a predetermined range, the board stops moving. Accordingly, the dice 40 on the dice rolling board 11 are thrown upwards and are thus rolled inside the dice rolling device 3. As shown in FIG. 4, an inclined face is formed at the periphery of the dice rolling board 11. Accordingly, the three dice 40 thus rolled roll on the inclined face and then stop on the dice rolling board 11.

The cover member 13 is formed in a hemispherical shape to cover the three dice 40 and the dice rolling board 11 (refer to FIG. 3 and FIG. 4). Specifically, the three dice 40 are rolled inside a space defined by the upper face of the dice rolling board 11 and the inner face of the cover member 13. The cover member 13 is made of a transparent acrylic material. Accordingly, the player can sufficiently see the dice 40 while being rolled inside the dice rolling device 3 and the dice 40 as stopped on the dice rolling board 11.

The rolling result detection unit 15 is installed at a top of the cover member 13 (refer to FIG. 3 and FIG. 4). The rolling result detection device 15 detects the spots on each die 40 which is stopped on the dice rolling board 11 (hereinafter referred to as rolling result). More specifically, the rolling result detection unit 15 acquires an image of each die 40 which is stopped on the dice rolling board 11. The rolling result detection unit 15 identifies the spots on each die 40 by carrying out a predetermined image process with respect to the images thus acquired. Here, information showing the identified spots on the three dice 40 is referred to as rolling result information.

The image processing for identifying the spots on dice 40 is heretofore known in the art. Therefore, further description thereof will hereby be omitted.

Figure 5:
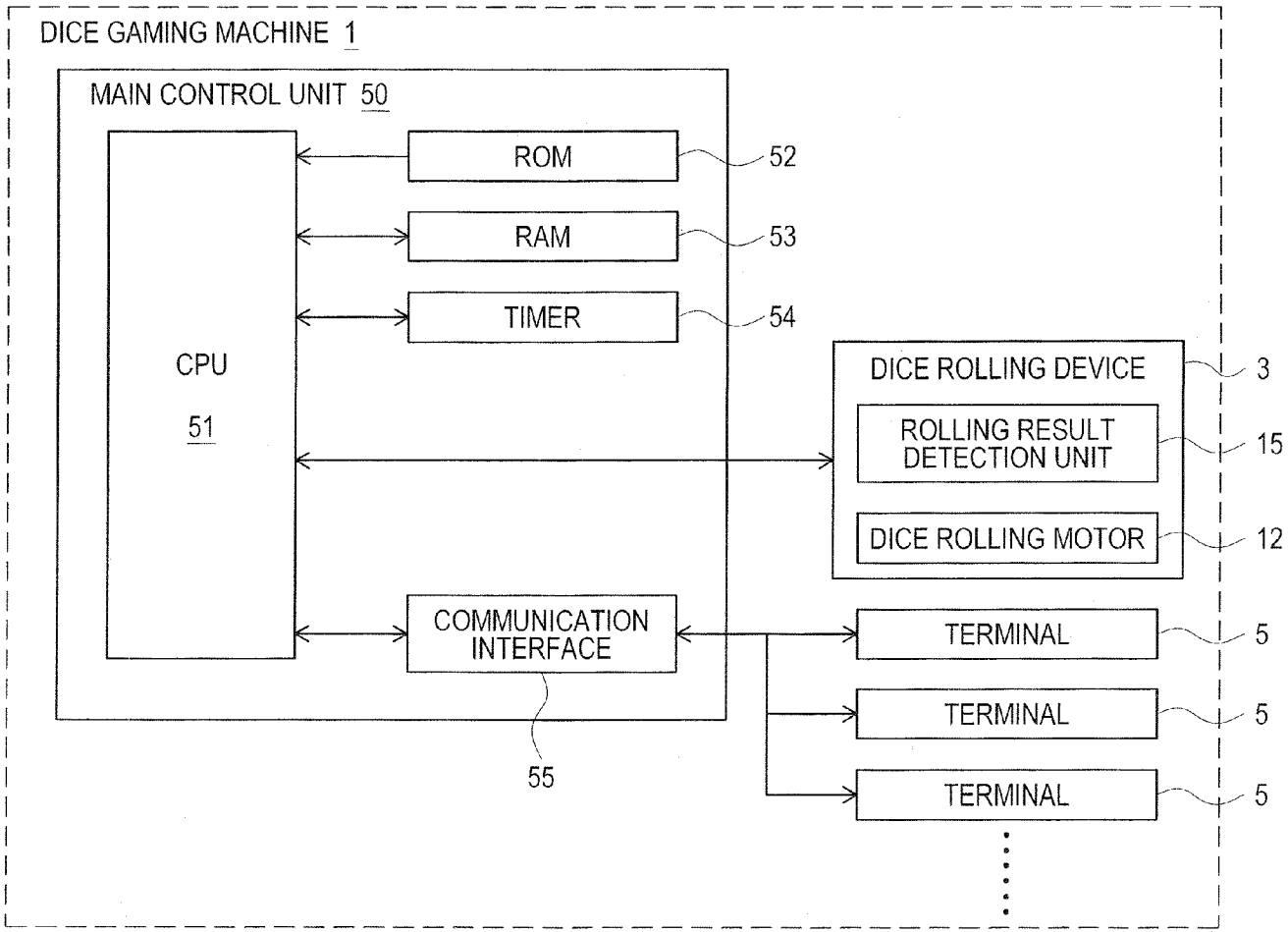
FIG. 5 is a block diagram showing an internal configuration of the dice gaming machine according to the first embodiment of the present invention.

Next, the internal configuration of the dice gaming machine 1 according to the first embodiment will be further described in detail while referring to the drawings. FIG. 5 is a block diagram showing an internal configuration of the dice gaming machine according to the first embodiment.

As shown in FIG. 5, the dice gaming machine 1 has a main control unit 50. The main control unit 50 controls the entire dice gaming machine 1. The main control unit 50 has a CPU 51, a ROM 52 and a RAM 53.

The CPU 51 is a central processing unit with respect to control by the main control unit 50. Specifically, the CPU 51 plays a central role in the control by the main control unit 50. In other words, the CPU 51 controls the entire dice gaming machine 1 by executing the various programs stored in the ROM 52. For instance, the CPU 51 progresses the dice game in the dice gaming machine 1 by executing a dice game execution process program (refer to FIG. 10, FIG. 11 and so on) as will be described later.

The ROM 52 stores various types of programs to be executed in the CPU 51. More specifically, the ROM 52 stores a dice game execution process program (refer to FIG. 10 and FIG. 11), a payout amount determination process program (refer to FIG. 12) and a lottery program and the like. The ROM 52 also stores various types of data tables. These data tables are referenced upon executing various programs. A payout table is also stored in the ROM 52.

Here, payout magnification ratios which are set at all bet areas 35 provided on the betting board 30 are associated with corresponding bet areas 35 respectively and stored in the payout table. In addition, payout magnification ratios which are set at all intermediate areas 42 provided on the betting board 30 are associated with corresponding intermediate areas 42 respectively and are stored therein.

The ROM 52 stores a BIOS (Basic Input/Output System) and an authentication program. When power is applied to the dice gaming machine 1, the CPU 51 executes the BIOS stored in the ROM 52. As a result, the CPU 51 initializes the peripheral devices constituting the dice gaming machine 1. The CPU 51 authenticates the dice game execution process program and the like by executing an authentication program.

At this time, the CPU 51 checks the presence of any alterations with respect to the dice game execution process program and the like. These processes are executed in an initial setting process executed at the time of applying power.

The RAM 53 temporarily stores the results of the processing executed by the CPU 51. Specifically, the RAM 53 temporarily stores the processing results following execution of the above-mentioned programs. The RAM 53 temporarily stores various types of information regarding the dice game (for instance, bet information transmitted from the terminals 5, rolling result information transmitted from the rolling result detection device 15 and the like).

The main control unit 50 has a timer 54 and a communication interface 55. The timer 54 is a clock device which is connected to the CPU 51. The CPU 51 references the measurement result of the timer 54 in the case of judging the lapse of the bet period and in the case of judging the arrival of rolling timing.

The bet period refers to the period of accepting the bet operation made by the players at the terminals 5. Specifically, lapse of the bet period indicates that acceptance of bets for gaming values with respect to the bet area 35, etc. has ended. Rolling timing indicates the timing when rolling of dice 40 inside the dice rolling device 3 is started.

The communication interface 55 is connected to the CPU 51. The communication interface 55 is also connected to the terminals 5 constituting the dice gaming machine 1. Specifically, the CPU 51 transmits various types of information and control signals with respect to the terminals 5 through the communication interface 55. Further, the CPU 51 can receive the information (for instance, bet information) and the control signals from the terminals 5 through the communication interface 55.

Further, the CPU 51 constituting the main control unit 50 is connected to the dice rolling device 3. As was described earlier, the dice rolling device 3 has a dice rolling motor 12 and a rolling result detection device 15. Accordingly, the CPU 51 can drive and control the dice rolling motor 12 by transmitting a predetermined control signal to the dice rolling device 3. Specifically, the CPU 51 can cause the dice 40 to roll and stop in the dice rolling device 3. The rolling result detection device 15 can identify a rolling result indicating the spots on the stopped dice 40. Accordingly, the CPU 51 can acquire the rolling result information based on the spots on the dice 40 as identified by the rolling result detection device 15 (S8).

Figure 6:
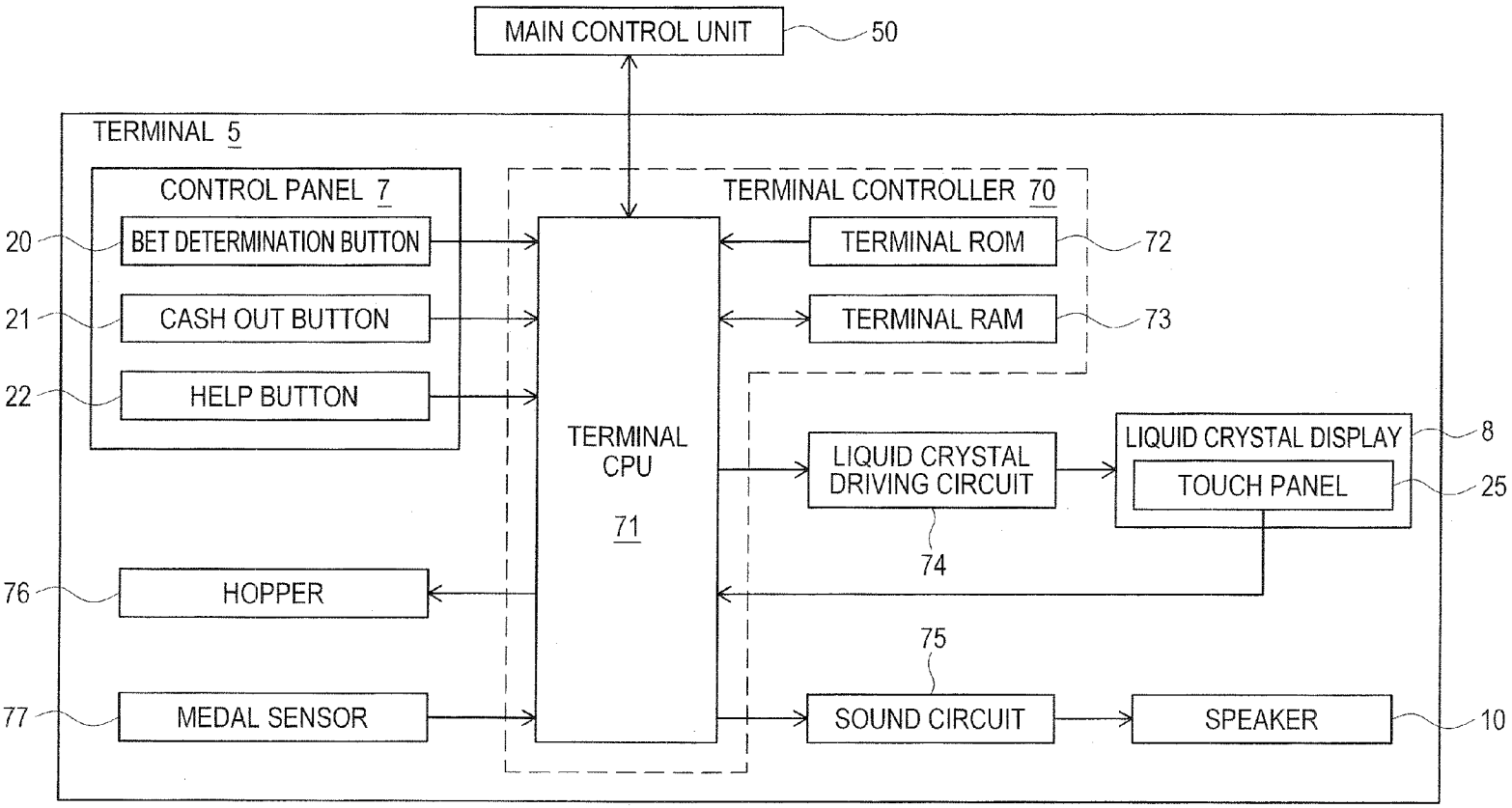
FIG. 6 is a block diagram showing an internal configuration of a terminal according to the first embodiment of the present invention.

Next, the terminals 5 constituting the dice gaming machine 1 will be described in detail while referring to the drawing. FIG. 6 is a block diagram showing the internal configuration of a terminal 5.

The terminals 5 constituting the dice gaming machine 1 all have the same configuration. Accordingly, the internal configuration of one terminal 5 will be described in detail. Description of the other terminals 5 constituting the dice gaming machine 1 will hereby be omitted.

As shown in FIG. 6, the terminal 5 has a terminal controller 70. This terminal controller 70 controls the various functions of the terminal 5. The terminal controller 70 has a terminal CPU 71, a terminal ROM 72 and a terminal RAM 73.

The terminal CPU 71 is a central processing unit with respect to control made by the terminal controller 70. Specifically, the terminal CPU 71 plays a central role in the control with respect to the terminal 5. More specifically, the terminal CPU 71 controls the terminal 5 by executing various types of programs stored in the terminal ROM 72. For instance, the terminal CPU 71 carries out control with respect to the dice game (for instance, control with respect to acceptance of bet operation and payment of payout) by executing the dice game execution process program (refer to FIG. 10 and FIG. 11) as will be described later.

The terminal ROM 72 stores various types of programs to be executed in the terminal CPU 71. More specifically, the terminal ROM 72 stores dice game execution process programs (refer to FIG. 10 and FIG. 11) and the like. The terminal ROM 72 stores various types of data tables. These data tables are referenced upon execution of the various programs.

The terminal ROM 72 also stores a BIOS (Basic Input/Output System) and an authentication program. When power is applied to the dice gaming machine 1, the terminal CPU 71 executes the BIOS stored in the terminal ROM 72. As a result, the terminal CPU 71 initializes the peripheral devices constituting the terminals 5. The terminal CPU 71 authenticates the dice game execution process program and the like by executing an authentication program. At this time, the terminal CPU 71 checks the presence of any alterations with respect to the dice game execution process program and the like. These processes are executed in an initial setting process executed at the time of power application.

The terminal RAM 73 temporarily stores the results of the processing executed in the terminal CPU 71. Specifically, the terminal RAM 73 temporarily stores the processing results following execution of the above-mentioned programs (for instance, bet information based on the players' bet operation). The terminal RAM 73 temporarily stores various types of information regarding the dice game (for instance, payout information transmitted from the main control unit 50 and the like).

The terminal CPU 71 is connected with the control panel 7. As was described earlier, the control panel 7 has a BET determination button 20, a CASHOUT button 21 and a HELP button 22. Specifically, the BET determination button 20, the CASHOUT button 21 and the HELP button 22 are each connected to the terminal CPU 71. Accordingly, when a player operates the BET determination button 20, the CASHOUT button 21 and the HELP button 22, a control signal based on each such operation can be inputted to the terminal CPU 71. The terminal CPU 71 can thus carry out control in accordance with the button that was operated, based on the operation signal thus inputted.

The terminal CPU 71 is connected with the liquid crystal display 8 through a liquid crystal driving circuit 74. The liquid crystal driving circuit 74 serves as a control circuit with respect to display on the liquid crystal display 8. The liquid crystal driving circuit 74 is made up of a program ROM, an image ROM, an image control CPU, a work RAM, a VDP (vide display processor) and a video RAM, etc. The program ROM stores various types of selection tables and image control programs regarding display on the liquid crystal display 8. The image ROM stores dot data. This dot data is used for forming images to be displayed on the liquid crystal display 8. The image control CPU determines images to be displayed on the liquid crystal display 8 from the dot data stored in the image ROM, based on the parameters set in the terminal CPU 71 and the image control program. The work RAM serves as a temporary storage device at the time the image control program is executed in the image control CPU. The VDP forms images in accordance with the display contents determined by the image control CPU. The VDP outputs the images thus formed to the liquid crystal display 8. The video RAM serves as a temporary storage device at the time images are formed in the VDP.

As was described earlier, the liquid crystal display 8 has a touch panel 25 provided at a front face thereof. As is shown in FIG. 6, the terminal CPU 71 is connected with the touch panel 25. The touch panel 25 detects the coordinate information corresponding to a portion touched by the player. Accordingly, the touch panel 25 can identify a player's operation with respect to the touch panel 25 based on the coordinate information. The operation information indicating a player's operation with respect to the touch panel 25 is transmitted from the touch panel 25 to the terminal CPU 71.

In the dice gaming machine 1 according to the first embodiment, when the betting board 30 is displayed on the liquid crystal display 8 (refer to FIG. 7), the players select the bet areas 35, etc. making up the betting board 30 and depress the unit BET button 31 using the touch panel 25. Accordingly, information with respect to the bet areas 35, etc. thus selected and the unit BET button 31 is transmitted from the touch panel 25 to the terminal CPU 71.

The terminal CPU 71 is connected with the speaker 10 through a sound circuit 75. The sound circuit 75 carries out control with respect to sound output from speaker 10 based on the control signal transmitted from the terminal CPU 71. The speaker 10 outputs various effect sounds in accordance with the progress of the dice game. As a result, the dice gaming machine 1 can execute effects in accordance with the progress of the dice game at each terminal 5.

The terminal CPU 71 is connected with a hopper 76 and a medal sensor 77. The hopper 76 pays out medals to the cash out port 9 based on the control signal from the terminal CPU 71. The medal sensor 77 detects the medals paid out from the hopper 76. As a result, the terminal CPU 71 can pay out a predetermined number of medals to the players by controlling the hopper 76 and the medal sensor 77.

Figure 7:
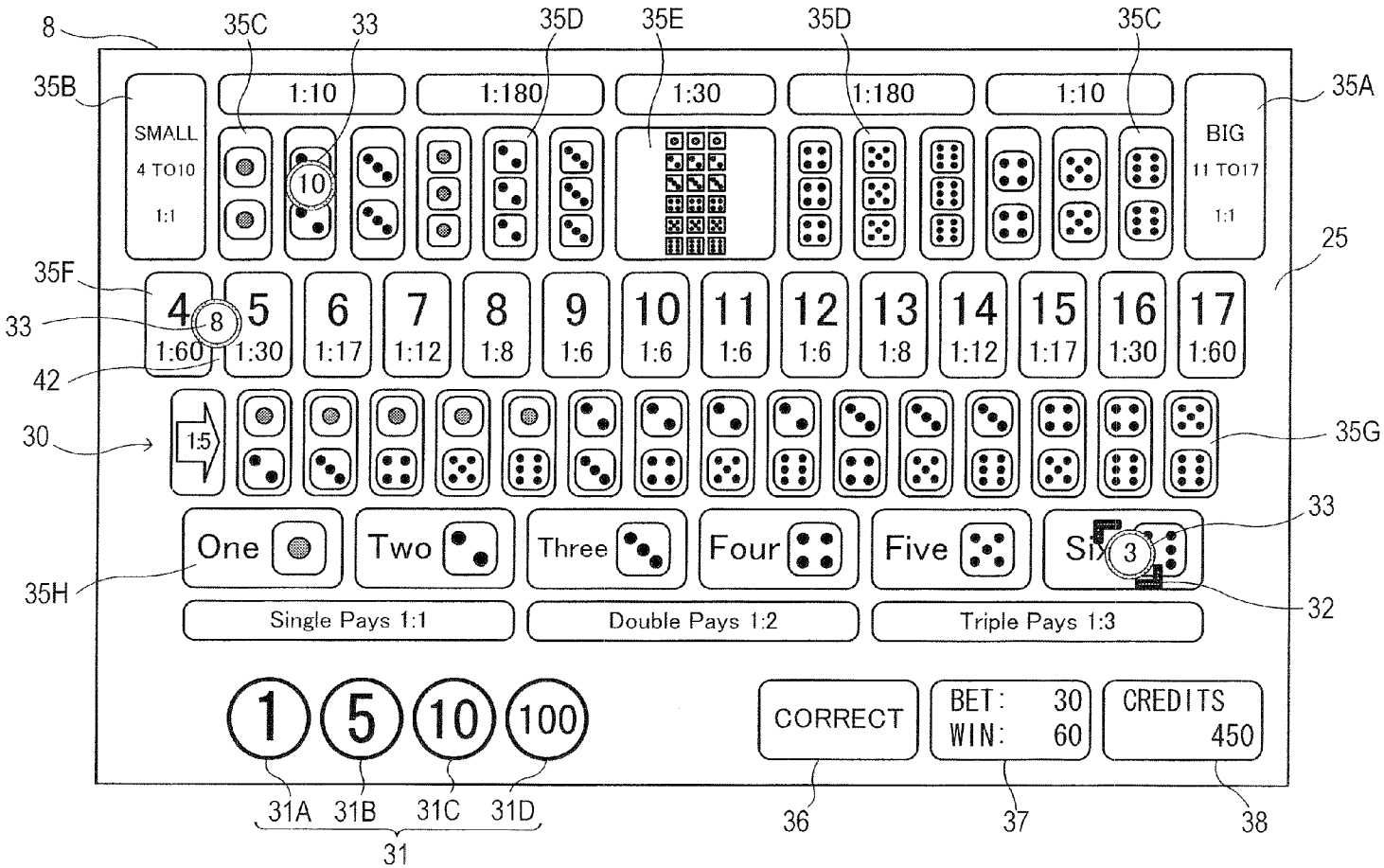
FIG. 7 is an exemplary view showing a game screen including a betting board according to the first embodiment of the present invention.

Next, a detailed description will be given with respect to the game screen to be displayed on the liquid crystal display 8 in the dice gaming machine 1 according to the first embodiment, while referring to the drawings. FIG. 7 is an explanatory diagram showing one example of a game screen to be displayed on the liquid crystal display 8.

As shown in FIG. 7, the game screen displayed on the liquid crystal display 8 includes the betting board 30. Here, when a dice game (e.g., Sic Bo) is played, the players bet gaming values with respect to the spots on the stopped three dice 40. The betting board 30 is used by the player in betting the gaming values.

The betting board 30 has a plurality of bet areas 35. Each bet area 35 is associated with a winning condition and a payout magnification ratio (i.e., base payout magnification ratio). The winning condition is the condition determined by the stopped three dice 40. The base payout magnification ratio shows a payout amount to be paid out in return to the unit gaming value (specifically, one credit) bet, in a case where the winning condition of the bet area 35 is satisfied.

In this embodiment, a payout magnification ratio (i.e., intermediate area payout magnification ratio) is provided to an intermediate area 42 between/among the plurality of bet areas 35. The intermediate area payout magnification ratio corresponds to a payout amount to be paid out with respect to the unit gaming value (i.e., one credit) being bet, when the winning condition is satisfied in any bet area 35 from amongst the plurality of bet areas 35 forming the corresponding intermediate area 42.

More specifically, the betting board 30 has eight types of bet areas 35. Specifically, the betting board 30 has a big bet area 35A, a small bet area 35B, a specific double bet area 35C, a specific triple bet area 35D, an any triple bet area 35E, a total bet area 35F, a combination bet area 35G and a number bet area 35H.

The big bet area 35A and the small bet area 35B are bet areas in each of which a condition is defined with a range of values as a result of adding up the spots on the stopped dice 40 (hereinafter referred to as total value). More specifically, the winning condition of the big bet area 35A is that "the total value is in a range between 11 and 17". The base payout magnification ratio of the big bet area 35A is set to 1:1 (two medals are paid out in return to a win with one medal placed as a bet). Alternatively, the winning condition of the small bet area 35B is that "the total value is in a range between 4 and 10". The base payout magnification ratio of the small bet area 35B is also set to 1:1.

The specific double bet area 35C is a bet area in which a winning condition is defined with a combination of spots on the stopped dice 40. More specifically, the winning condition of the specific double bet area 35C is satisfied if "amongst the three dice 40 which are stopped, the spots on two dice 40 are the same, and the spots on these two dice 40 correspond to specific spots". The betting board 30 has six specific double bet areas 35C. Accordingly, if the spots on two dice 40 from amongst the three dice 40 are "1,1", "2,2", "3,3" . . . or "6,6", the winning condition for one specific double bet area 35C is satisfied (refer to FIG. 7). The base payout magnification ratio of each specific double bet area 35C is set to 1:10.

The specific triple bet area 35D is a bet area in which a winning condition is defined with a combination of spots on the stopped three dice 40. More specifically, the winning condition of the specific triple bet area 35C is satisfied if "the spots on the three dice 40 which are stopped are the same and the spots on the three dice 40 correspond to specific spots". The betting board 30 has six specific triple bet areas 35D. Accordingly, if the spots on the three dice 40 are "1,1,1", "2,2,2", "3,3,3" . . . or "6,6,6", the winning condition for one specific triple bet area 35D is satisfied (refer to FIG. 7). The base payout magnification ratio of each specific triple bet area 35C is set to 1:180.

The any triple bet area 35E is a bet area in which a winning condition is defined with a combination of the spots on the stopped three dice 40. More specifically, the winning combination of the any triple bet area 35E is satisfied if "the spots on the stopped dice 40 are all the same". Accordingly, if the spots on the three dice 40 are "1,1,1", "2,2,2", "3,3,3" or "6,6,6", the winning combination of the any triple bet area 35E is satisfied (refer to FIG. 7). The base payout magnification ratio of the any triple bet area 35E is set to 1:30.

The total bet area 35F is a bet area in which a winning condition is defined with a total value of the spots on the stopped three dice 40. More specifically, the winning combination of the total bet area 35F is satisfied if "the total value is a specific value". As shown in FIG. 7, the betting board 30 has fourteen total bet areas 35E Specifically, the betting board 30 has a total bet area 35F corresponding to each total value "4", "5" . . . "17". As shown in FIG. 7, the base payout magnification ratio of each total bet area 35F is set in accordance with the appearance frequency of the total value for each winning condition. For instance, if the winning condition for the total value "16" is the total bet area 35F thus set, the base payout magnification ratio is 1:30.

The combination bet area 35G is a bet area in which a winning condition is defined with a combination of the spots on the stopped dice 40. More specifically, the winning condition of the combination bet area 35G is satisfied if "the spots on two dice 40 from amongst the stopped three dice 40 correspond to a specific combination". As shown in FIG. 7, the betting board 30 has fifteen combination bet areas 35G. The base payout magnification ratio for the combination bet area 35G is set to 1:5.

The combination for the case that the spots on two dice 40 are the same is excluded from the combination bet area 35G.

The number bet area 35H is a bet area in which a winning condition is defined with the spots' numbers on the dice 40. More specifically, the winning combination of the number bet area 35H is satisfied if "a specific spot is included in the spots on the stopped three dice 40". As shown in FIG. 7, the betting board 30 has six number bet areas 35H. One number bet area 35H corresponds to any of "1", "2" . . . "6". The base payout magnification ratio of the number bet area 35H is set to "1:1", "1:2", "1:3", in accordance with the number of dices showing the spots corresponding to the winning combination.

The intermediate area payout magnification ratio which is set for an intermediate area 42 between/among a plurality of bet areas is decided in accordance with the base payout magnification ratios of the plurality of bet areas 35 forming the intermediate area 42. In this embodiment, an intermediate area 42 formed only by the bet areas 35 associated with a same type of winning condition (e.g., total bet areas 35F) is targeted as the intermediate area 42 on which a bet is accepted. Accordingly, as is illustrated in FIG. 1, a bet is accepted on an intermediate area 42 located between a total bet area 35F whose winning condition is satisfied if the total of the spot numbers of stopped dice 40 is "4", and a total bet area 35F whose winning condition is satisfied if the total of the spot numbers of stopped dice 40 is "5". In contrast, a bet is not accepted on an intermediate area 43 located between a total bet area 35F whose winning condition is satisfied if the total of the spot numbers of stopped dice 40 is "5", and a combination bet area 35G whose winning condition is satisfied if the spots on two dice 40 from amongst the stopped three dice 40 correspond to a combination of "one" and "two".

An intermediate area payout magnification ratio to be set with respect to the intermediate area 42 between/among a plurality of bet areas is decided in accordance with either method of method (A) or method (B).

(A) In the case where all bet areas forming an intermediate area 42 have the same base payout magnification ratio (for instance, in the case where combination bet areas 35G form an intermediate area 42, and the like):

In such a case, the intermediate area payout magnification ratio of the intermediate area 42 is obtained through dividing the base payout magnification ratio of each bet area 35 forming the intermediate area 42 by the number of bet areas 35 forming the intermediate area 42.

Figure 8:
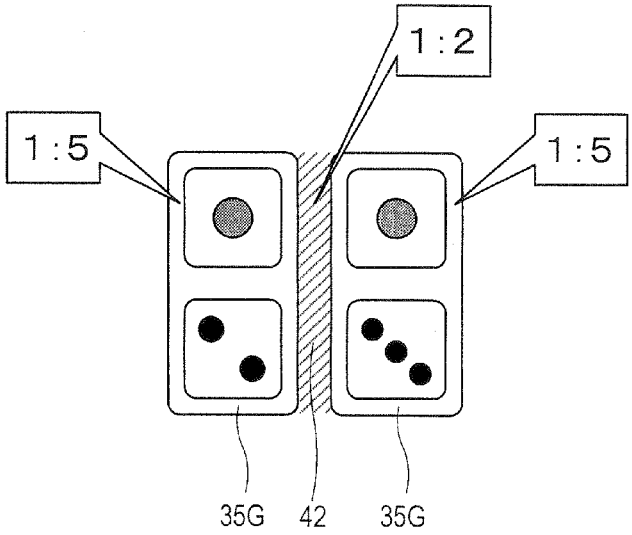
FIG. 8 is an exemplary diagram showing one example of an intermediate area payout magnification ratio set at the dice gaming machine according to the first embodiment of the present invention.

Here is explained an example of an intermediate area payout magnification ratio set for an intermediate area 42 between combination bet areas 35G as shown in FIG. 8.

As shown in FIG. 8, the base payout magnification ratio is set to "1:5" in a combination bet area 35G whose winning condition is that the spots on two dice 40 from amongst the stopped three dice 40 correspond to a combination of "one" and "two". Similarly, the base payout magnification ratio is set to "1:5" in a combination bet area 35G whose winning condition is that the spots on two dice 40 from amongst the stopped three dice 40 correspond to a combination of "one" and "three".

Accordingly, the intermediate area payout magnification ratio of the intermediate area 42 is set to "1:2".

In this case, the expected value obtained when a certain amount of gaming value is bet on the intermediate area 42 is the same as the expected value obtained when the certain amount is divided by the number of the bet areas 35 forming the intermediate area 42 into equal amounts and the equal amounts are respectively bet on all the bet areas 35 forming the intermediate area 42.

Here, the expected value of a bet area 35 is calculated through multiplying the winning probability of the bet area 35 by the amount of unit gaming value (specifically, "bet amount: 1") and the payout magnification ratio of the bet area 35. The winning probability of the bet area 35 is the probability that the winning condition of the bet area 35 will be satisfied in one dice game. For instance, the winning probability of a certain specific triple bet area 35D is "1/216".

Also, the expected value of an intermediate area 42 is calculated through multiplying the probability that the winning condition of any of the bet areas 35 forming the intermediate area 42 will be satisfied by the amount of unit gaming value (specifically, "bet amount: 1") and the payout magnification ratio of the intermediate area 42.

(B) In the case where the bet areas forming an intermediate area 42 have different base payout magnification ratios (for instance, in the case where total bet areas 35F form the intermediate area 42, and the like).

In such a case, the intermediate area payout magnification ratio of the intermediate area 42 is set so that the expected value of the intermediate area 42 is between the maximum value and the minimum value from amongst the expected values of the respective bet areas 35 forming the intermediate area 42, and so that, at the same time, the expected value obtained when a certain amount of gaming value is bet on the intermediate area 42 is higher than the expected value obtained when the certain amount is divided by the number of the bet areas 35 forming the intermediate area 42 into equal amounts and the equal amounts are respectively bet on all the bet areas 35 forming the intermediate area 42.

Figure 9:
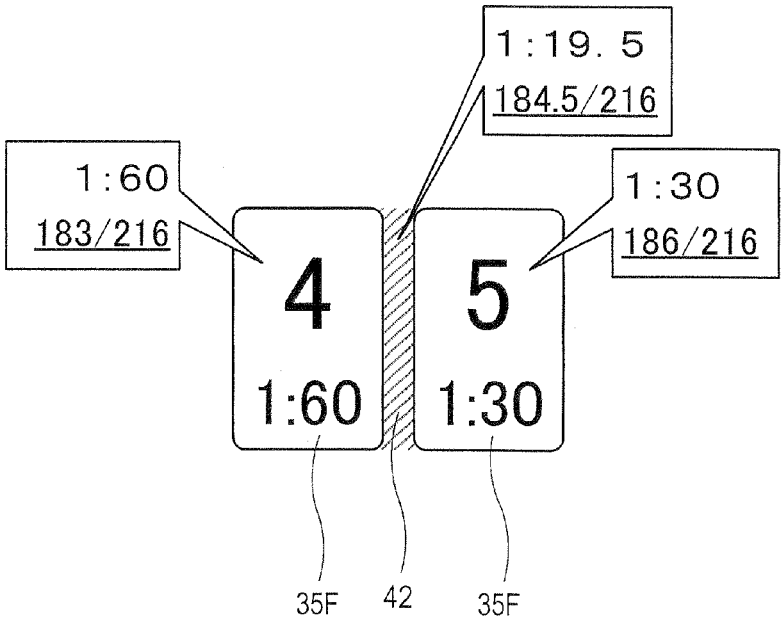
FIG. 9 is an exemplary diagram showing one example of an intermediate area payout magnification ratio set at the dice gaming machine according to the first embodiment of the present invention.

Here is explained an example of an intermediate area payout magnification ratio set for an intermediate area 42 between a total bet area 35F whose winning condition is satisfied if the total of the spot numbers of stopped dice 40 is "4" and a total bet area 35F whose winning condition is satisfied if the total of the spot numbers of stopped dice 40 is "5" as shown in FIG. 9.

As shown in FIG. 9, "1:60" is set to the base payout magnification ratio of the total bet area 35F whose winning condition is satisfied if the total of the spot numbers of stopped dice 40 is "4". The probability that the total of the spot numbers of stopped dice becomes "4" is 3/216.

Accordingly, the following formula (1) is used for the calculation of the expected value $F_1$ of the total bet area 35F whose winning condition is satisfied if the total of the spot numbers of stopped dice 40 is "4":

$$F_1=3/216\times61=183/216 \quad (1)$$

Meanwhile, "1:30" is set to the base payout magnification ratio of the total bet area 35F whose winning condition is satisfied if the total of the spot numbers of stopped dice 40 is "5". The probability that the total of the spot numbers of stopped dice becomes "5" is 6/216.

Accordingly, the following formula (2) is used for the calculation of the expected value $F_2$ of the total bet area 35F whose winning condition is satisfied if the total of the spot numbers of stopped dice 40 is "5":

$$F_2=6/216\times31=186/216 \quad (2)$$

A value which satisfies the following conditional expressions (3) and (4) is the expected value $F_3$ of the intermediate area 42 between the total bet area 35F whose winning condition is satisfied if the total of the spot numbers of stopped dice 40 is "4" and the total bet area 35F whose winning condition is satisfied if the total of the spot numbers of stopped dice 40 is "5":

$$F_1 \leqq F_3 \leqq F_2 \quad (3)$$

$$F_3 \geqq (F_1+F_2)/2 \quad (4)$$

Here, the above conditional expression (3) defines the condition that the expected value $F_3$ of the intermediate area 42 lies between the minimum value $F_1$ and the maximum value $F_2$ from amongst the expected values of the total bet areas 35F forming the intermediate area 42.

Also, the above conditional expression (4) defines the condition that the expected value obtained when a certain amount of gaming value is bet on the intermediate area 42 is higher than the expected value obtained when the certain amount is divided by the number of the bet areas 35 forming the intermediate area 42 into equal amounts and the equal amounts are respectively bet on all the bet areas 35 forming the intermediate area 42.

Further, the intermediate area payout magnification ratio X of the intermediate area 42 is calculated based on the value $F_3$ which satisfies both of the conditional expressions (3) and (4) and the probability that one of the bet areas 35 forming the intermediate area 42 satisfies the winning condition. Here, the probability that the total of the spot numbers of stopped dice 40 is either "4" or "5" is 9/216. Accordingly, the intermediate area payout magnification ratio X of the intermediate area 42 as shown in FIG. 9 is calculated, specifically, using the following formula (5):

$$X=F_3/(9/216) \quad (5)$$

Here, if 184.5/216 is selected as the value of $F_3$ which satisfies both of the conditional expressions (3) and (4), the intermediate area payout magnification X of the intermediate area 42 as shown in FIG. 9 is "X=20.5".

Accordingly, "1:19.5" is set to the intermediate area payout magnification ratio of the intermediate area 42.

The game screen can include a cursor 32 and a chip mark 33. The cursor 32 and the chip mark 33 are displayed on the betting board 30 in accordance with a player's operation. The cursor 32 shows the bet area 35, etc. which is currently selected by the player. The chip mark 33 shows the amount of gaming values bet with respect to the bet area 35, etc. (hereinafter referred to as bet amount). As shown in FIG. 7, the chip mark 33 shows the above-mentioned bet amount through the number displayed at the center of the chip mark 33. The chip mark 33 is displayed on the bet area 35, etc. Specifically, the chip mark indicates the bet area 35, etc. onto which the bet is made through the location of its display.

Further, as shown in FIG. 7, the game screen includes a unit BET button 31, a CORRECT button 36, a payout result display portion 37 and a credit amount display portion 38.

The unit BET button 31 is formed at a lower left side of the betting board 30. The unit BET button 31 is used to set the bet amount with respect to the bet area 35, etc. selected by the player.

As shown in FIG. 7, the unit BET button 31 is made up of 1 BET button 31A, 5 BET button 31B, 10 BET button 31C and 100 BET button 31D. The 1 BET button 31A is operated by the player to increase the bet amount with respect to the bet area 35, etc. selected by the player by "1". The 5 BET button 31B is operated by the player to increase the bet amount with respect to the bet area 35, etc. selected by the player by "5".

The 10 BET button 31C is operated by the player to increase the bet amount with respect to the bet area 35, etc. selected by the player by "10". The 100 BET button 31D is operated by the player to increase the bet amount with respect to the bet area 35, etc. selected by the player by "100".

Each time the player carries out such operation, the unit BET button 31 adds a bet amount in accordance with such operation to the current bet amount.

The CORRECT button 36 is operated to cancel the bet area 35, etc. already selected and the setting of the bet amount. If selection of the bet area 35, etc. and setting of the bet amount are incorrect, the player can correct the bet area 35, etc. and the bet amount by operating this CORRECT button 36.

The payout result display portion 37 displays the total bet amount in the previous game and the payout amount in the previous game (the payout credit amount).

The credit amount display portion 38 displays the credit amount possessed by the player. The display contents of the credit amount display portion 38 are updated based on the bet with respect to the bet area 35, etc. and award of the payout in the dice game.

Next, the bet operation carried out by the player using the game screen will be described. As was described earlier, the touch panel 25 is installed at a front face of the liquid crystal display 8. The touch panel 25 transmits the coordinate information corresponding to the portion touched by the player to the terminal CPU 71. Accordingly, if the game screen is displayed on the liquid crystal display 8, the player can select the bet area 35, etc. and set the bet amount using the touch panel 25.

More specifically, the player first touches with his/her finger, etc. the touch panel 25 at the portion corresponding to the desired bet area 35 or the touch panel 25 at the portion corresponding to the desired intermediate area 42. As a result, the player selects the desired bet area 35, etc. At this time, the cursor 32 is displayed on the bet area 35 or the intermediate area 42 thus selected. Thereafter, the player touches with his/her finger, etc. the touch panel 25 at the portion corresponding to the unit BET button 31. As a result, the player selects the bet amount with respect to the selected bet area 35, etc. Once the bet amount is selected, the chip mark 33 is displayed on the bet area 35 or the intermediate area 42.

Figure 10:
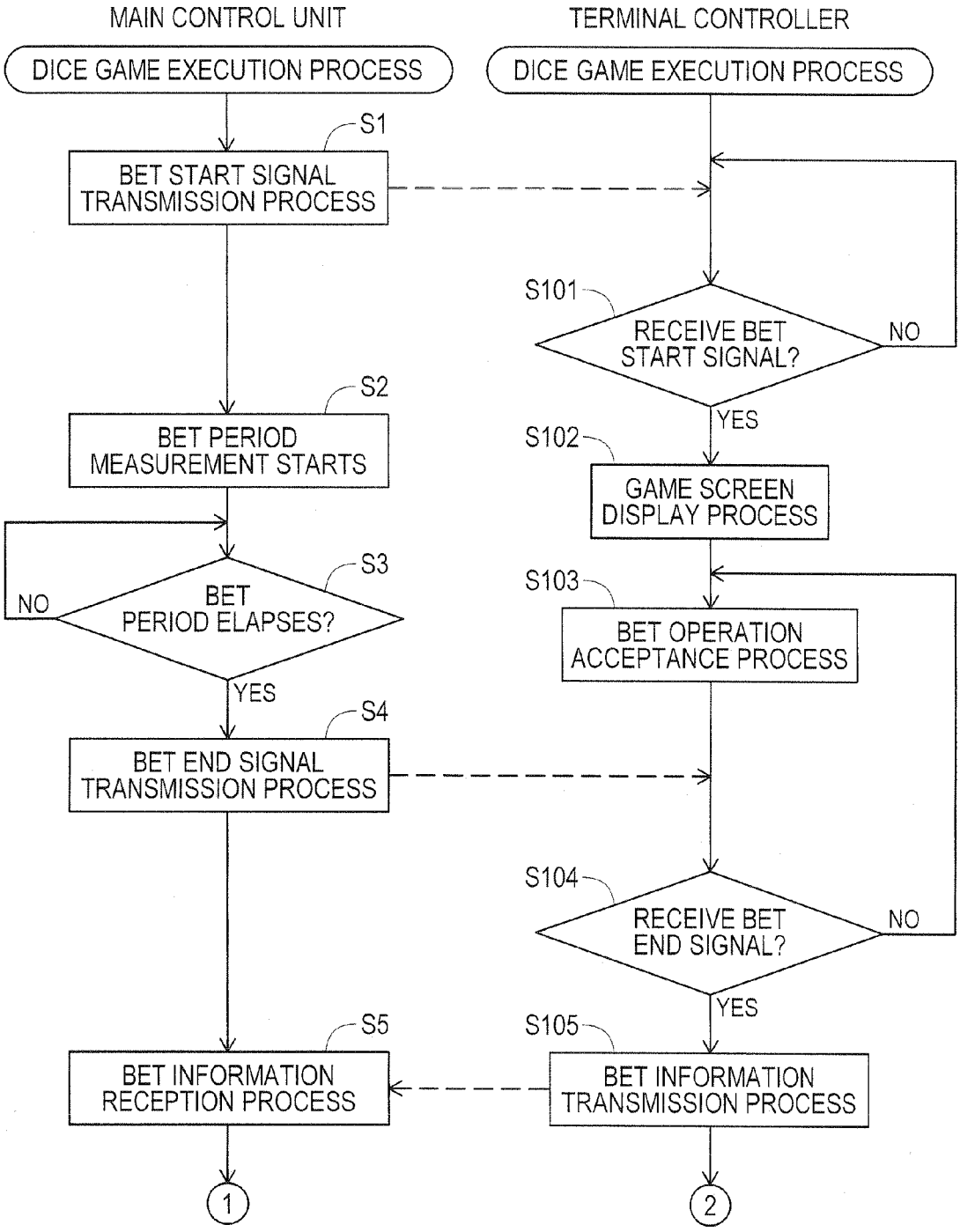
FIG. 10 is a flow chart (1) of a dice game execution process program according to the first embodiment of the present invention.
Figure 11:
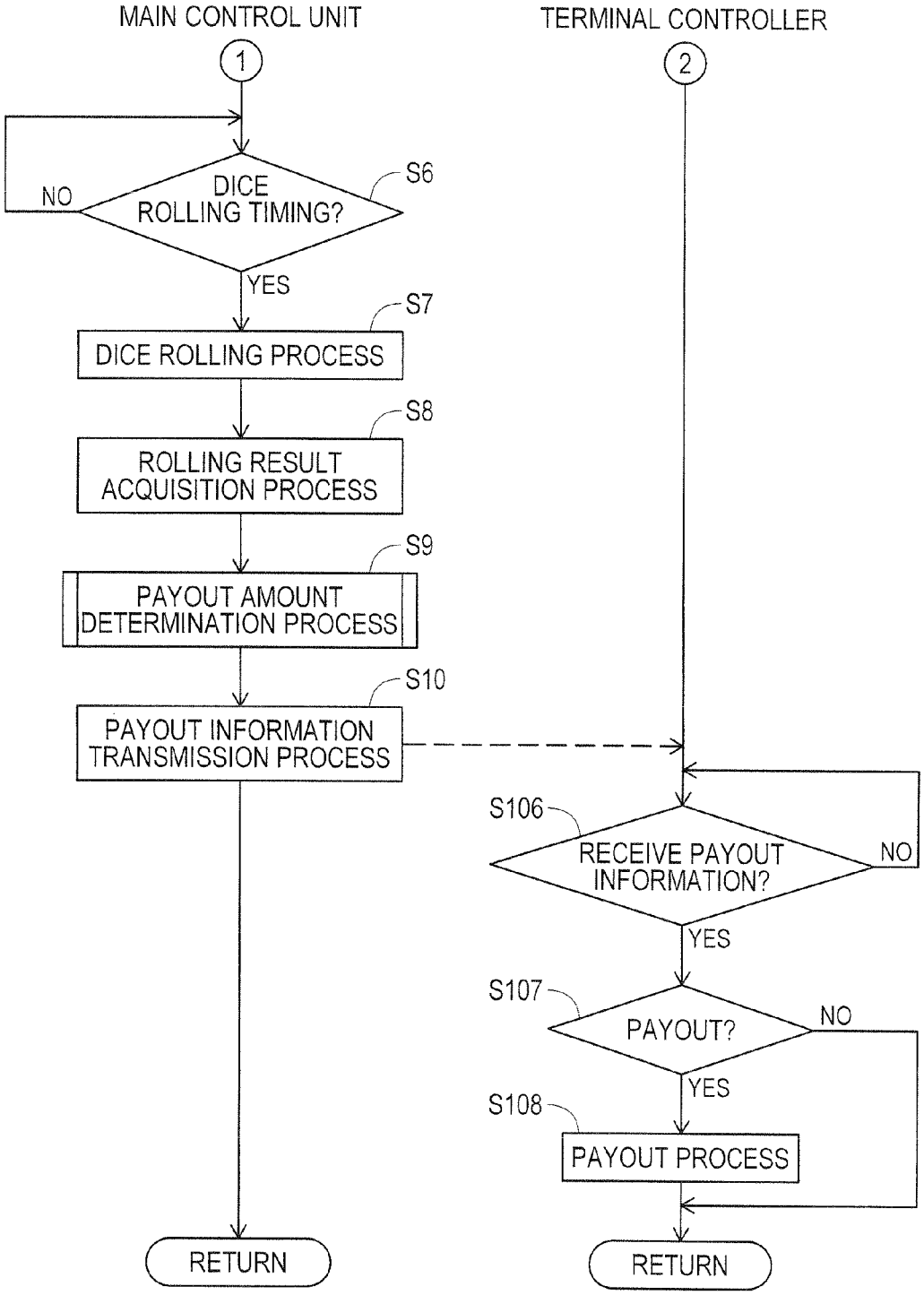
FIG. 11 is a flow chart (2) of the dice game execution process program according to the first embodiment of the present invention.

Next, a dice game execution process program to be executed in the dice gaming machine 1 according to the first embodiment will be described in detail while referring to the drawings. FIG. 10 and FIG. 11 are flow charts of the dice game execution process program.

The initial setting process executed in the main control unit 50 and the initial setting process executed in the terminal controller 70 of each terminal 5 are executed prior to the dice game execution process program. Specifically, the main control unit 50 and the terminal controller 70 end initialization of the peripheral devices and the program authentication process. These initial setting processes are heretofore known in the art. Therefore, description of the contents of such processes is hereby omitted.

First, the dice game execution process program in the main control unit 50 will be described in detail.

Once execution of the dice game execution process program is started, the CPU 51 first executes the bet start signal transmission process (S1). In the bet start signal transmission process (S1), the CPU 51 transmits the bet start signal to the terminals 5 through the communication interface 55. The bet start signal serves to instruct start of the bet period in the terminals 5. The bet period is the period for accepting the players' bets for the gaming values with respect to the bet areas 35 at each terminal 5. After the bet start signal is transmitted to the terminals 5, the CPU 51 shifts the process to S2.

Once the bet start signal is received, the terminal CPU 71 executes the game screen display process (S102) and the bet operation acceptance process (S103). This will be described in more detail later.

After shifting to S2, the CPU 51 starts measuring the bet period. More specifically, the CPU 51 transmits the control signal to the timer 54. As a result, the timer 54 starts measurement. After the control signal is transmitted to the timer 54, the CPU 51 shifts the process to S3.

At S3, the CPU 51 judges whether the bet period has lapsed. More specifically, the CPU 51 references the measurement results of the timer 54. The CPU 51 judges whether the predetermined period (e.g., bet period) has lapsed based on the measurement result of the timer 54. If the bet period has lapsed (S3: YES), the CPU 51 shifts the process to S4. Alternatively, if the bet period has not lapsed yet (S3: NO), the CPU 51 puts the process in stand-by until the bet period lapses.

At S4, the CPU 51 executes the bet end signal transmission process. In the bet end signal transmission process (S4), the CPU 51 transmits a bet end signal to the terminals 5. The bet end signal serves to instruct ending of the bet period in each terminal 5. In other words, the bet end signal means that acceptance of bets for gaming values in the terminal 5 is ended. After the bet end signal is transmitted to each terminal 5, the CPU 51 shifts the process to S5.

Once the bet end signal is received, the terminal CPU 71 ends the bet operation acceptance process (S103). Accordingly, the terminal 5 ends acceptance of bets with respect to the bet areas 35. Thereafter, the terminal CPU 71 transmits the bet information based on the bet operation carried out in the bet operation acceptance process (S103) to the main control unit 50 (S105). This bet information includes information showing the bet area 35 on which the gaming value has been bet and information showing the bet amount bet on the bet area 35 in question. The bet information includes identification information showing the terminal 5 from which the bet information is transmitted.

After shifting to S5, the CPU 51 executes the bet information reception process. In the bet information reception process (S5), the CPU 51 receives the bet information transmitted from each terminal 5 through the communication interface 55. The CPU 51 stores the bet information thus received in the RAM 53. At this time, the CPU 51 classifies the bet information for each terminal 5 based on the identification information included in the bet information. Once the bet information reception process (S5) ends, the CPU 51 shifts the process to S6.

At S6, the CPU 51 judges whether the dice rolling timing has arrived. The dice rolling timing shows the timing at which rolling of the three dice 40 is started in the dice rolling device 3. More specifically, at S6, the CPU 51 first references the measurement results of the timer 54. Specifically, the CPU 51 carries out the judgment process at S6 based on the measurement result of timer 54. When the dice rolling timing arrives (S6: YES), the CPU 51 shifts the process to S7. Alternatively, if the dice rolling timing has not yet arrived (S6: NO), the CPU 51 puts the process in stand-by until such dice rolling timing arrives.

At S7, the CPU 51 executes a dice rolling process. In this dice rolling process (S7), the CPU 51 transmits a control signal to the dice rolling device 3. As a result, the dice rolling motor 12 is driven and controlled. Accordingly, the three dice 40 are rolled inside the dice rolling device 3. The three dice 40 which have been rolled are then stopped on the dice rolling board 11. Once the dice rolling process ends, the CPU 51 shifts the process to S8.

At S8, the CPU 51 executes a rolling result acquisition process. In this rolling result acquisition process (S8), the CPU 51 acquires the rolling result information showing the spots on the stopped three dice 40, by controlling the rolling result detection device 15 of the dice rolling device 3. More specifically, the CPU 51 transmits the control signal to the dice rolling device 3. Upon receiving the control signal, the dice rolling device 3 acquires an image with an imaging device provided in the dice rolling device 3. The acquired image includes the image of the stopped three dice 40 on the dice rolling board 11. Thereafter, the dice rolling device 3 carries out a predetermined image process with respect to the acquired image by controlling the rolling result detection device 15. As a result, the dice rolling device 3 can identify the spots on the three dice 40 which are stopped on the dice rolling board 11. The dice rolling device 3 generates rolling result information showing the spots on the three dice 40 thus identified. The dice rolling device 3 then transmits the rolling result information thus generated to the CPU 51. Once the rolling result information acquired from the dice rolling device 3 is stored in the RAM 53, the CPU 51 shifts the process to S9.

Figure 12:
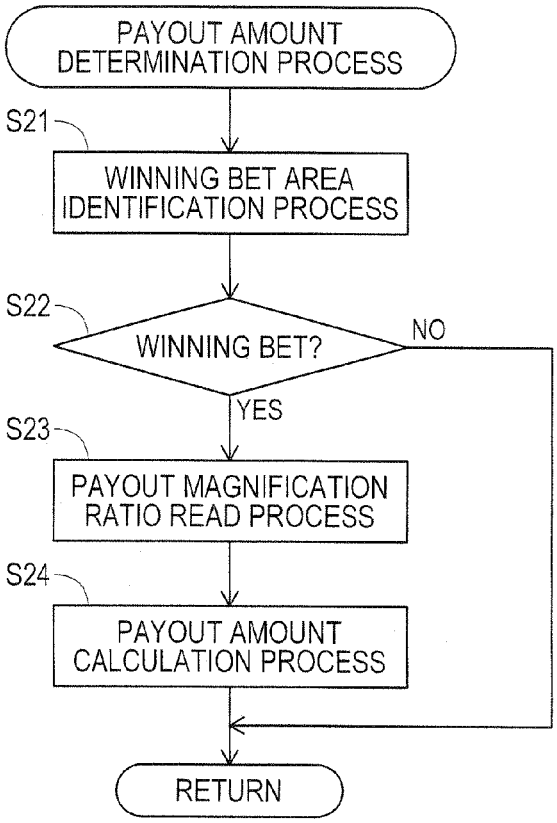
FIG. 12 is a flow chart of a payout amount determination process program according to the first embodiment of the present invention.

After shifting to S9, the CPU 51 executes a payout amount determination process (FIG. 12). In this payout amount determination process (S9), the CPU 51 executes a payout amount determination process program (refer to FIG. 12) as will be described later. In this payout amount determination process, the CPU 51 calculates the payout amount of each terminal 5 based on the rolling result information and the bet information of each terminal 5. The contents of the payout amount determination process (S9) will next be described in detail. Once the payout amount determination process ends, the CPU 51 shifts the process to S10.

At S10 the CPU 51 executes a payout information transmission process. In this payout information transmission process (S10), the CPU 51 transmits the payout information to each terminal 5 through the communication interface 55. This payout information shows the payout amount calculated in the payout amount determination process (S9). After transmitting the payout information to each terminal 5, the CPU 51 ends the payout information transmission process. The CPU 51 then ends the dice game execution process program in the main control unit 50.

Once execution of the dice game execution process program is ended, the CPU 51 restarts execution of the dice game execution process program. Specifically, the CPU 51 repeatedly executes the dice game execution process program while power is being supplied to the dice gaming machine 1.

Next, the dice game execution process program at each terminal 5 will next be described in detail.

Upon starting the dice game execution process program, the terminal CPU 71 first judges whether the bet start signal has been received (S101). As was described earlier, the bet start signal serves to instruct start of the bet period in the dice gaming machine 1. The bet start signal is transmitted from the main control unit 50 to each terminal 5 (S1). If the bet start signal is received (S101: YES), the terminal CPU 71 shifts the process to S102. As a result, the bet period in each terminal 5 is started. Alternatively, if the bet start signal has not yet been received (S101: NO), the terminal CPU 71 puts the process in stand-by until the bet start signal is received.

After shifting to S102, the terminal CPU 71 executes a game screen display process. In this game screen display process (S102), the terminal CPU 71 transmits the control signal to the liquid crystal driving circuit 74. The game screen is displayed on the liquid crystal display 8 based on the control of the liquid crystal driving circuit 74 (refer to FIG. 7). Once the game screen is displayed on the liquid crystal display 8, the terminal CPU 71 shifts the process to S103.

At S103, the terminal CPU 71 executes a bet operation acceptance process. In this bet operation acceptance process (S103), the terminal CPU 71 accepts a player's operation using the touch panel 25. More specifically, the terminal CPU 71 carries out various types of controls corresponding to a player's operation based on the operation signal transmitted from the touch panel. Such controls include control with respect to selecting the bet area 35, etc., control with respect to setting the bet amount corresponding to the selected bet area 35, etc. and control corresponding to operation of the CORRECT button 36.

If the bet area 35 is selected and the bet amount with respect to the selected area 35, etc. is set, the terminal CPU 71 stores the bet information in the terminal RAM 73. The bet information includes information with respect to the selected bet area 35, etc. and information showing the bet amount of the bet area 35, etc.

In the next step S104, the terminal CPU 71 judges whether the bet end signal has been received. As was described earlier, the bet end signal shows the end of the bet period. Specifically, reception of the bet end signal means that acceptance of bets in the current dice game ends. The bet end signal is transmitted from the main control unit 50 (S4). If the bet end signal is received (S104: YES), the terminal CPU 71 shifts the process to S105. Alternatively, if the bet end signal has not yet been received (S104: NO), the terminal CPU 71 returns the process to the bet operation acceptance process (S103). Thus, the player at each terminal can bet a gaming value in the current game until the end of the bet period.

After shifting to S105, the terminal CPU 71 executes a bet information transmission process. In this bet information transmission process (S105), the terminal CPU 71 transmits the bet information stored in the terminal RAM 73 to the main control unit 50. Here, the terminal CPU 71 adds identification information showing the terminal 5 in question to the bet information. After receiving the bet information including the identification information, the terminal CPU 71 shifts the process to S106.

At S106, the terminal CPU 71 judges whether payout information has been received. The payout information shows the payout amount to be paid out at the corresponding terminal 5. The payout information is transmitted from the main control unit 50 (S10). If it is judged that the payout information has been received (S106: YES), the terminal CPU 71 shifts the process to S107. Alternatively, if it is judged that the payout information has not been received (S106: NO), the terminal CPU 71 stands-by until it receives the payout information.

Next, at S107, the terminal CPU 71 determines whether the payout with respect to the current dice game is to be paid out, based on the payout information currently received. The cases where a payout is paid out are as follows: a case that the spots on the rolled dice 40 satisfy the winning condition of the bet area 35, when the player has made a bet on a bet area 35; and a case that any bet area 35 from amongst the bet areas 35 forming the intermediate area 42 satisfies the winning condition thereof, when the player has made a bet on an intermediate area 42.

If it is determined that the payout for the current dice game is to be paid out (S107: YES), the terminal CPU 71 executes a payout process (S108). Alternatively, if it is determined that the payout for the current dice game is not to be paid out (S107: NO), the terminal CPU 71 terminates the dice game execution process program without executing the payout process (S108).

After shifting to S108, the terminal CPU 71 executes a payout process. In this payout process (S108), the terminal CPU 71 awards to the player a payout in the current dice game based on the payout information. Specifically, the terminal CPU 71 adds the payout amount calculated in a later-described payout amount calculation process (S24) to the credit amount owned by the player. The payout amount can also be awarded in the form of medals which are paid out from the cash out port 9. Once the payout process ends, the terminal CPU 71 ends the dice game execution process program in the terminal 5.

Once execution of the dice game execution process program ends, the terminal CPU 71 restarts execution of the dice game execution process program. Specifically, the terminal CPU 71 can repeatedly execute the dice game execution process program while power is being supplied to the dice gaming machine 1.

Next, the payout amount determination process program to be executed by the CPU 51 in the payout amount determination process (S9) will be described in detail while referring to the drawings. FIG. 12 is a flow chart of the payout amount determination process program.

In the dice game execution process program of the main control unit 50, after shifting to the payout amount determination process (S9), the CPU 51 executes a winning bet area identification process. In the winning bet area identification process (S21), the CPU 51 identifies the winning bet area based on the rolling result information and the winning condition set for each bet area 35. The winning bet area is the bet area 35 whose specified winning condition is satisfied by the spots on the stopped dice 40. As was described earlier, the rolling result information shows the spots on the three stopped dice 40 which have been identified by the rolling result detection unit 15. Accordingly, the CPU 51 identifies the winning bet area based on the rolling result information and the winning condition of each bet area 35. After identifying the winning bet area, the CPU 51 shifts the process to S22.

After shifting to S22, the CPU 51 judges whether or not any of the bets is a winning bet. The winning bet refers to the gaming values bet on the winning bet area identified in the winning bet area identification process (S21), or the gaming values bet on the intermediate area 42 formed by bet areas 35 including the winning bet area (hereinafter referred to as winning intermediate area). More specifically, the CPU 51 carries out the judgment process at S22 based on the bet information of each terminal 5 stored in the RAM 53. If a winning bet has been made (S22: YES), the CPU 51 shifts the process to S23.

Alternatively, if none of the bets are winning bets (S22: NO), the CPU 51 sets the payout amount at each terminal 5 to "0". Thereafter, the CPU 51 ends the payout amount determination process program. Here, the case that none of the bets are winning bets includes the case that no bets for gaming values are made with respect to the bet areas 35 and the case that all gaming values are bet with respect to a bet area 35 other than the winning bet area, or an intermediate area 42 other than the winning intermediate area.

At S23, the CPU 51 reads the base payout magnification ratio for the winning bet area and the intermediate area payout magnification ratio of the winning intermediate area from the payout table stored in ROM 52. The payout table stores base payout magnification ratios for all bet areas 35 provided on the betting board 30, being associated with the respective bet areas 35. In addition, intermediate area payout magnification ratios for all intermediate areas 42 provided on the betting board 30 are stored, being associated with the respective intermediate areas 42.

Shifting to S24, the CPU 51 executes a payout amount calculation process. In the payout amount calculation process (S24), the CPU 51 calculates payout amount with respect to the current game for all terminals 5. Specifically, the CPU 51 calculates the payout amount for each terminal 5 with respect to the current game through carrying out the following processes at every terminal 5.

Specifically, the CPU 51 calculates the payout amount related to the winning bet area through multiplying the bet amount on the winning bet area by the "base payout magnification ratio" with respect to the winning bet area. Also, the CPU 51 calculates the payout amount related to the winning intermediate area through multiplying the bet amount on the winning intermediate area by the "intermediate area payout magnification ratio" with respect to the winning intermediate area. If bets for gaming values are made with respect to a plurality of winning bet areas or a plurality of intermediate areas, the CPU 51 calculates a payout amount corresponding to each winning bet area and each winning intermediate area.

The CPU 51 sets the payout amounts corresponding to the bet areas other than the winning bet area to "0". Similarly, the payout amounts corresponding to the intermediate areas other than the winning intermediate area are set to "0". The CPU 51 adds up the payout amounts of the bet areas calculated through the processes described above, for each terminal 5. As a result, the CPU 51 calculates the resultant payout amount of each terminal 5. The CPU 51 stores the information showing the payout amount at each terminal 5 in the RAM 53. The information showing the payout amount of each terminal 5 makes up the payout information of each terminal 5. Then, the CPU 51 ends the payout amount determination process program. As shown in FIG. 11, once the payout amount determination process (S9) ends, the CPU 51 shifts the process to the payout information transmission process (S10).

As was described earlier, in the payout information transmission process (S10), the CPU 51 respectively transmits the payout information showing the payout amount thus calculated from the main control unit 50 to every terminal 5. In each terminal 5, the terminal CPU 71 executes the payout process (S108) based on the payout information thus received.

As described above, the dice gaming machine 1 according to the first embodiment accepts a bet on a bet area 35 and a bet on an intermediate area 42 between/among a plurality of bet areas 35 (S103). After ending the bet acceptance, it starts rolling dice (S7). After the rolling of the dice has been stopped, the dice gaming machine 1 identifies a winning bet area based on the dice rolling result (S21). A payout amount for each terminal is calculated based on the identified winning bet area, the bet area 35 or the intermediate area 42 on which the bet is accepted, and a payout magnification ratio set for the bet area 35 or the intermediate area 42 (S24). New locations on which a bet can be accepted can thus be created on the intermediate areas between/among bet areas. Accordingly, the dice gaming machine 1 can improve the convenience of players while allowing players to enjoy much wider variety of gaming elements.

The present invention is not limited to the embodiments described above, but various improvements and modifications can be made thereto without departing from the spirit of the present invention.

For instance, in the first embodiment, a bet is accepted only on an intermediate area 42 formed by bet areas 35 related to the same type of winning condition (e.g., total bet areas 35F); however, a bet may be accepted on an intermediate area 43 formed by bet areas related to different types of winning conditions (e.g., a total bet area 35F and a combination bet area 35G). Additionally, a bet may be accepted on an intermediate area formed by more than two bet areas 35.

The present invention can also be realized as a gaming method for executing the above-described processes. Further, the present invention can also be realized as a program for causing a computer to execute such gaming method, and a recording medium onto which such program is recorded.

[Second Embodiment]

Figure 13:
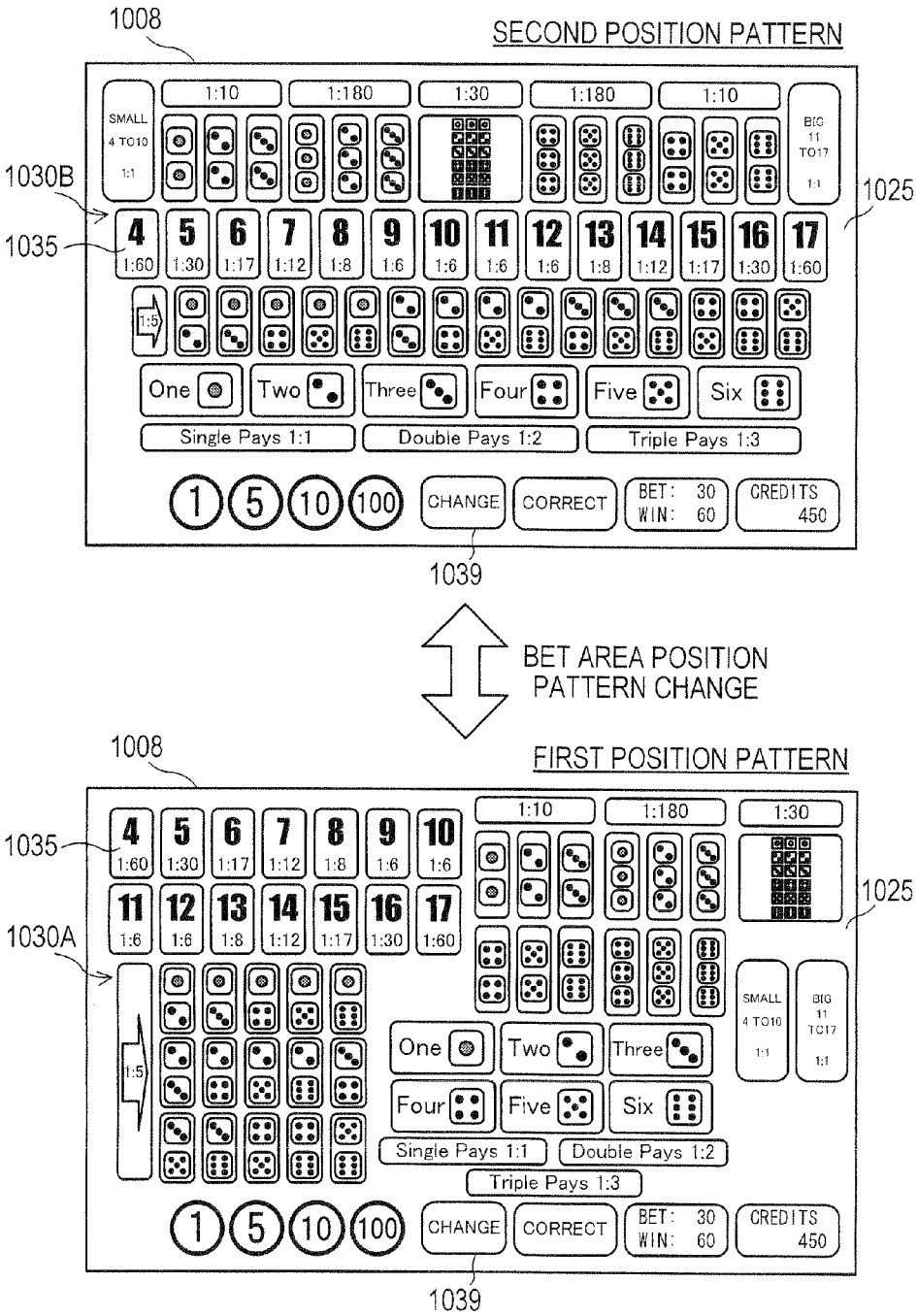
FIG. 13 is an exemplary diagram showing the characteristics of the dice gaming machine according to the second embodiment of the present invention.

Next, characteristics of a dice gaming machine 1001 will be described according to the second embodiment. FIG. 13 is an exemplary view showing characteristics of a dice gaming machine 1001 according to the second embodiment.

A dice game which is called "Sic Bo" is played in the dice gaming machine 1001. In "Sic-Bo", three dice 1040 are rolled. Players predict the result of dice rolling (specifically, the spots on the three dice 1040). Also, the players bet gaming values on a betting board 1030A or a betting board 1030B based on their prediction.

Here, the betting boards 1030A and 1030B are made up of a plurality of bet areas 1035 (refer to FIG. 13, etc.). The position pattern of the plurality of bet areas making up the betting board 1030A (hereinafter referred to as first position pattern) is different from the position pattern of the plurality of bet areas making up the betting board 1030B (hereinafter referred to as second position pattern). Specifically, the first position pattern represents a position pattern in which bet areas associated with the same winning condition are positioned so as to be in a matrix state. The second position pattern represents a position pattern similar to the position pattern conventionally used at "Sic Bo". Each time a player depresses the CHANGE button 1039, the position pattern of the bet area 1035 is switched over between the first position pattern and the second position pattern. Specifically, when the CHANGE button 1039 is depressed with the betting board 1030A displayed on the liquid crystal display 1008, the betting board 1030B is displayed on the liquid crystal display 1008 in place of the betting board 1030A. Conversely, when the CHANGE button 1039 is depressed with the betting board 1030B displayed on the liquid crystal display 1008, the betting board 1030A is displayed on the liquid crystal display 1008 in place of the betting board 1030B.

In addition, each bet area 1035 is associated with a winning condition and a payout magnification ratio. The winning condition is a condition defined by spot(s) on some or all of the three dice 1040. If the spots on the rolled dice 1040 satisfy the winning condition, the player who placed a bet on this bet area 1035 wins a prize. The payout magnification ratio is used for determining the contents of the prize which is thus awarded. More specifically, the payout magnification ratio defines the magnification ratio of the prize (payout amount) to be awarded with respect to a unit gaming value (specifically, one credit) thus bet. Specifically, players bet gaming values with respect to a bet area 1035 corresponding to their prediction as described above.

If the spots on the rolled dice 1040 satisfy the winning condition defined for the bet area that is placed a bet by the player, the player wins a prize. The prize in this case is determined by multiplying the amount of gaming value bet by the player by the payout magnification ratio of the bet area 1035 in question.

Here, the dice gaming machine 1001 according to the second embodiment has a special feature of accepting a bet on an intermediate area located between/among a plurality of bet areas 1035. When a player makes a bet on the intermediate area, if any bet area 1035 from amongst the plurality of bet areas 1035 forming the intermediate area satisfies a winning condition, a prize is awarded to the player.

At the same time an intermediate area between/among bet areas 1035 has a predetermined payout magnification ratio thereat (hereinafter referred to as an intermediate area payout magnification ratio) based on the magnification ratio of each of the bet areas 1035 forming the intermediate area. If any bet area 1035 from amongst the plurality of bet areas 1035 forming the intermediate area satisfies a winning condition, an amount, which is obtained through multiplying the amount of a gaming value being bet on the intermediate area by the intermediate area payout magnification ratio which is set previously, is paid out as a prize.

Figure 14:
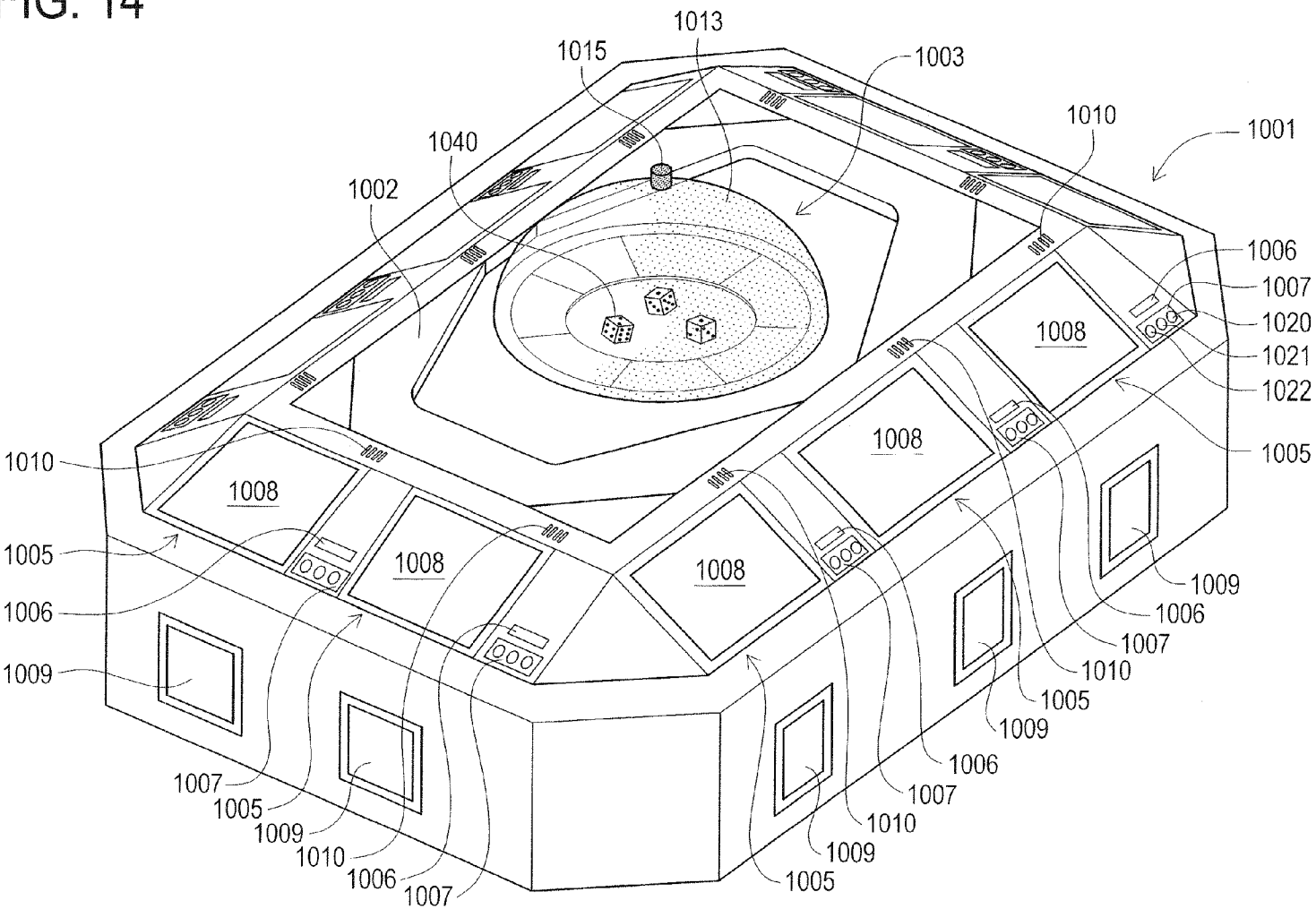
FIG. 14 is a perspective view showing an outer appearance of the dice gaming machine according to the second embodiment of the present invention.

Next, a schematic configuration of the dice gaming machine 1001 will be described in detail while referring to the drawings. FIG. 14 is a schematic diagram showing an outer appearance of the dice gaming machine 1001 according to the second embodiment.

As shown in FIG. 14, the dice gaming machine 1001 according to the second embodiment has a cabinet 1002, a dice rolling device 1003 and a plurality of terminals 1005 (in the second embodiment, ten terminals). The cabinet 1002 makes up the main part of the dice gaming machine 1001. The cabinet 1002 houses electrical components and mechanical components such as a main control unit 1050 and the like as will be described later.

The dice rolling device 1003 is installed at a central portion on an upper face of the cabinet 1002. The dice rolling device 1003 has a dice box. The dice box houses three dice 1040 therein. The three dice 1040 are rolled inside the dice box and are then stopped. The configuration of the dice rolling device 1003 will be described in detail later.

The terminals 1005 are installed at the periphery of the dice rolling device 1003. The terminals 1005 each have a liquid crystal display 1008. The terminals 1005 are used in a player's operation with respect to the dice game (e.g., Sic Bo) played in the dice gaming machine 1001. Specifically, players enter the dice game played in the dice gaming machine 1001 by using the terminals 1005.

The terminals 1005 each have a medal acceptance device 1006, a control panel 1007 and a liquid crystal display 1008. The medal acceptance device 1006 accepts medals, an exemplary type of gaming value, inserted by the player. Specifically, in the case of playing the dice game, the player inserts medals, an exemplary type of gaming value, in the medal acceptance device 1006. The gaming values thus inserted are stored as credit. The player places a bet onto a bet area 1035 using such credit.

The control panel 1007 is installed at a lower side of the medal acceptance device 1006. This control panel 1007 has a plurality of operation buttons. More specifically, the control panel 1007 also has a BET determination button 1020, a CASHOUT button 1021 and a HELP button 1022.

The BET determination button 1020 is operated by the player to determine a bet operation. Specifically, the player operates the BET determination button 1020 to determine a bet area 1035 or an intermediate area between/among a plurality of bet areas 1035 (hereinafter referred to as "bet area 1035, etc." including a bet area 1035 and an intermediate area) which will be the bet target and also to determine the amount of gaming values to be bet with respect to the bet area 1035, etc. (hereinafter referred to as bet amount). Meanwhile, in this embodiment, there are intermediate areas such as a first intermediate area 1042 located between two bet areas and a second intermediate area 1043 located among four bet areas (refer to FIG. 21).

The CASHOUT button 1021 is operated by the player to request payout of the credits he/she possesses. When this CASHOUT button 1021 is operated, medals are paid out from a cash out port 1009 in accordance with the number of credits that the player possesses.

The HELP button 1022 is operated in case the operation method and the rules of the game are unclear. When the HELP button 1022 is operated, the dice gaming machine 1001 displays a HELP screen containing explanations with respect to the game operation method and the like onto the liquid crystal display 1008.

The liquid crystal display 1008 is a display device for displaying information with respect to the dice game. When the dice game is started, each liquid crystal display 1008 displays an image of the betting board 1030A or the betting board 1030B. The touch panel 1025 is arranged at a front face of the liquid crystal display 1008 in each terminal 1005. Accordingly, the player carries out a bet operation with respect to the bet area 1035 using this touch panel 1025.

Each terminal 1005 has a cash out port 1009 and a speaker 1010. The cash out port 1009 is arranged at a lower side of the liquid crystal display 1008. This cash out port 1009 serves to output medals. For instance, once the CASHOUT button 1021 is operated, a number of medals corresponding to the credits the player possesses are paid out to the cash out port 1009. Speaker 1010 is installed at a right upper side of the liquid crystal display 1008. The speaker 1010 outputs sounds based on the progress of the game.

Next, the dice rolling device 1003 installed in the dice gaming machine 1001 will be described in detail while referring to the drawings.

As shown in FIG. 14, the dice rolling device 1003 is installed at an upper face of the cabinet 1002. The dice rolling device 1003 houses three dice 1040 therein. The three dice 1040 are rolled inside the dice rolling device 1003 by controlling the operation of the dice rolling motor 1012 as will be described later. The rolled dice 1040 are then stopped on a dice rolling board 1011. The dice rolling device 1003 is installed at a central portion of the cabinet 1002. Accordingly, players who are seated at the terminals 1005 can see the dice 1040 as they are being rolled inside the dice rolling device 1003 and the spots on the dice 1040 after these are stopped inside the dice rolling device 1003.

Figure 15:
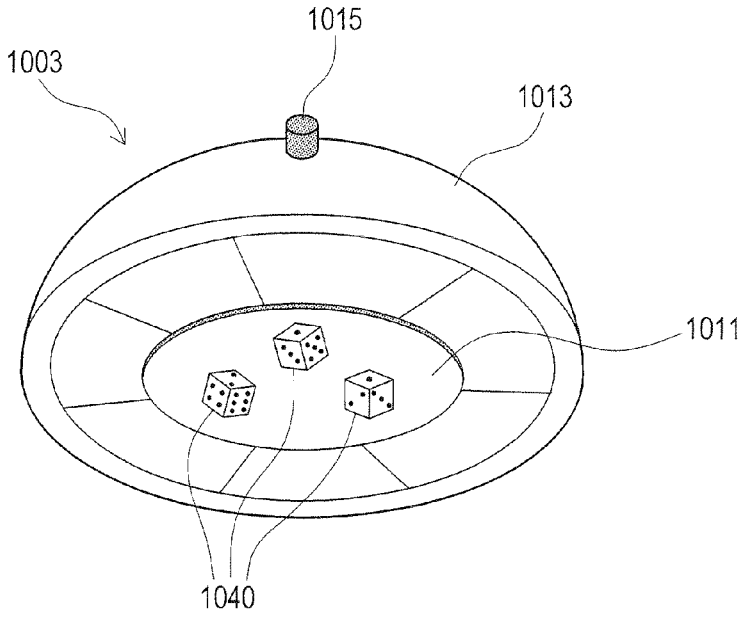
FIG. 15 is a view showing an outer appearance of a dice rolling device according to the second embodiment of the present invention.
Figure 16:
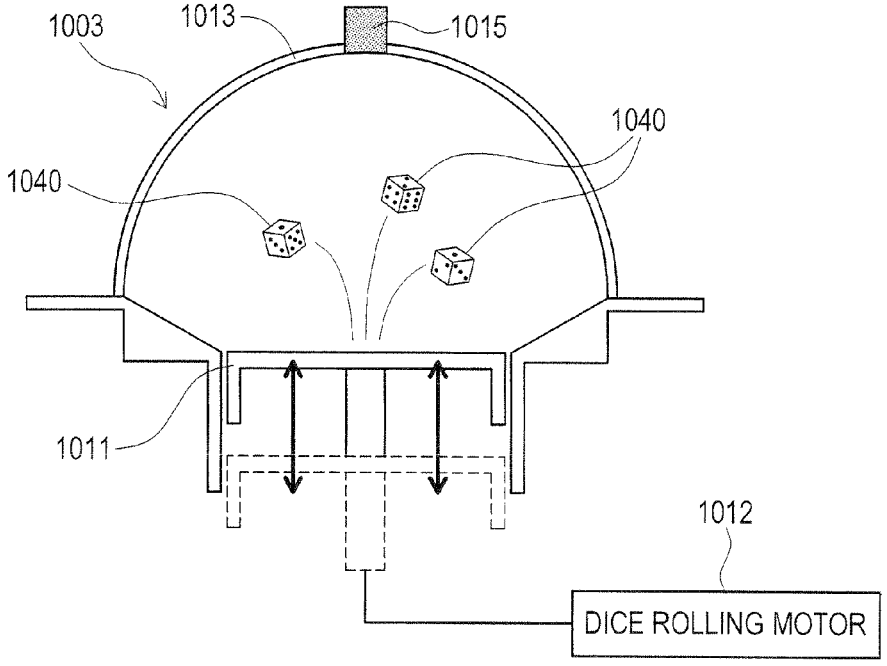
FIG. 16 is an exemplary diagram relating to an operation of the dice rolling device according to the second embodiment of the present invention.

As shown in FIG. 15 and FIG. 16, the dice rolling device 1003 has a dice rolling board 1011, a dice rolling motor 1012, a cover member 1013 and a rolling result detection unit 1015. The dice rolling board 1011 moves up and down within a predetermined range inside the dice rolling device 1003 (refer to FIG. 16). The dice rolling board 1011 is connected to the dice rolling motor 1012. Specifically, the dice rolling board 1011 moves up and down within the predetermined range based on driving and control of the dice rolling motor 1012.

As shown in FIG. 16, in case of rolling the dice 1040, the dice rolling motor 1012 causes the dice rolling board 1011 to move upwards at a certain speed or faster. Once the dice rolling board 1011 moves over a predetermined range, the board stops moving. Accordingly, the dice 1040 on the dice rolling board 1011 are thrown upwards and are thus rolled inside the dice rolling device 1003. As shown in FIG. 16, an inclined face is formed at the periphery of the dice rolling board 1011. Accordingly, the three dice 1040 thus rolled roll on the inclined face and then stop on the dice rolling board 1011.

The cover member 1013 is formed in a hemispherical shape to cover the three dice 1040 and the dice rolling board 1011 (refer to FIG. 15 and FIG. 16). Specifically, the three dice 1040 are rolled inside a space defined by the upper face of the dice rolling board 1011 and the inner face of the cover member 1013. The cover member 1013 is made of a transparent acrylic material. Accordingly, the player can sufficiently see the dice 1040 while being rolled inside the dice rolling device 1003 and the dice 1040 as stopped on the dice rolling board 1011.

The rolling result detection unit 1015 is installed at a top of the cover member 1013 (refer to FIG. 15 and FIG. 16). The rolling result detection device 1015 detects the spots on each die 1040 which is stopped on the dice rolling board 1011 (hereinafter referred to as rolling result). More specifically, the rolling result detection unit 1015 acquires an image of each die 1040 which is stopped on the dice rolling board 1011. The rolling result detection unit 1015 identifies the spots on each die 1040 by carrying out a predetermined image process with respect to the images thus acquired. Here, information showing the identified spots on the three dice 1040 is referred to as rolling result information.

The image processing for identifying the spots on dice 1040 is heretofore known in the art. Therefore, further description thereof will hereby be omitted.

Next, the internal configuration of the dice gaming machine 1001 according to the second embodiment will be further described in detail while referring to the drawings.

Figure 17:
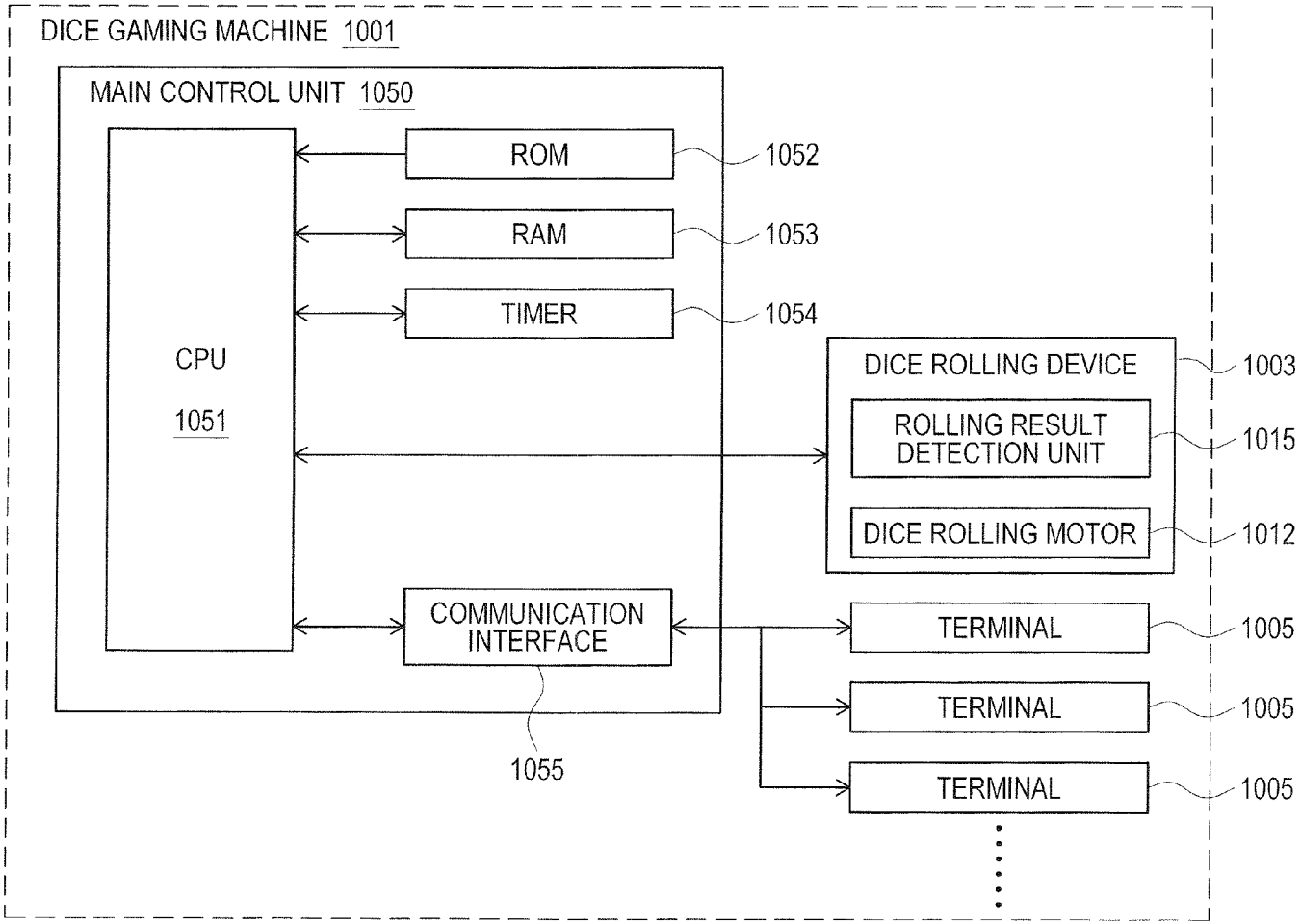
FIG. 17 is a block diagram showing an internal configuration of the dice gaming machine according to the second embodiment of the present invention.

FIG. 17 is a block diagram showing an internal configuration of the dice gaming machine according to the second embodiment.

As shown in FIG. 17, the dice gaming machine 1001 has a main control unit 1050. The main control unit 1050 controls the entire dice gaming machine 1001. The main control unit 1050 has a CPU 1051, a ROM 1052 and a RAM 1053.

The CPU 1051 is a central processing unit with respect to control by the main control unit 1050. Specifically, the CPU 1051 plays a central role in the control by the main control unit 1050. In other words, the CPU 1051 controls the entire dice gaming machine 1001 by executing the various programs stored in the ROM 1052. For instance, the CPU 1051 progresses the dice game in the dice gaming machine 1001 by executing a dice game execution process program (refer to FIG. 22, FIG. 23 and so on) as will be described later.

The ROM 1052 stores various types of programs to be executed in the CPU 1051. More specifically, the ROM 1052 stores a dice game execution process program (refer to FIG. 22 and FIG. 23), a payout amount determination process program (refer to FIG. 24) and a lottery program and the like. The ROM 1052 also stores various types of data tables. These data tables are referenced upon executing various programs. A payout table is also stored in the ROM 1052.

Here, payout magnification ratios which are set at all bet areas 1035 provided on the betting boards 1030A and 1030B are associated with corresponding bet areas 1035 respectively and stored in the payout table. In addition, payout magnification ratios which are set at all first intermediate areas 1042 and all second intermediate areas 1043 provided on the betting boards 1030A and 1030B are associated with corresponding intermediate areas 1042 and intermediate areas 1043 respectively and are stored therein.

The ROM 1052 stores a BIOS (Basic Input/Output System) and an authentication program. When power is applied to the dice gaming machine 1001, the CPU 1051 executes the BIOS stored in the ROM 1052. As a result, the CPU 1051 initializes the peripheral devices constituting the dice gaming machine 1001. The CPU 1051 authenticates the dice game execution process program and the like by executing an authentication program. At this time, the CPU 1051 checks the presence of any alterations with respect to the dice game execution process program and the like. These processes are executed in an initial setting process executed at the time of applying power.

The RAM 1053 temporarily stores the results of the processing executed by the CPU 1051. Specifically, the RAM 1053 temporarily stores the processing results following execution of the above-mentioned programs. The RAM 1053 temporarily stores various types of information regarding the dice game (for instance, bet information transmitted from the terminals 1005, rolling result information transmitted from the rolling result detection device 1015 and the like).

The main control unit 1050 has a timer 1054 and a communication interface 1055. The timer 1054 is a clock device which is connected to the CPU 1051. The CPU 1051 references the measurement result of the timer 1054 in the case of judging the lapse of the bet period and in the case of judging the arrival of rolling timing.

The bet period refers to the period of accepting the bet operation made by the players at the terminals 1005. Specifically, lapse of the bet period indicates that acceptance of bets for gaming values with respect to the bet area 1035, etc. has ended. Rolling timing indicates the timing when rolling of dice 1040 inside the dice rolling device 1003 is started.

The communication interface 1055 is connected to the CPU 1051. The communication interface 1055 is also connected to the terminals 1005 constituting the dice gaming machine 1001. Specifically, the CPU 1051 transmits various types of information and control signals with respect to the terminals 1005 through the communication interface 1055. Further, the CPU 1051 can receive the information (for instance, bet information) and the control signals from the terminals 1005 through the communication interface 1055.

Further, the CPU 1051 constituting the main control unit 1050 is connected to the dice rolling device 1003. As was described earlier, the dice rolling device 1003 has a dice rolling motor 1012 and a rolling result detection device 1015. Accordingly, the CPU 1051 can drive and control the dice rolling motor 1012 by transmitting a predetermined control signal to the dice rolling device 1003. Specifically, the CPU 1051 can cause the dice 1040 to roll and stop in the dice rolling device 1003. The rolling result detection device 1015 can identify a rolling result indicating the spots on the stopped dice 1040. Accordingly, the CPU 1051 can acquire the rolling result information based on the spots on the dice 1040 as identified by the rolling result detection device 1015 (S1008).

Figure 18:
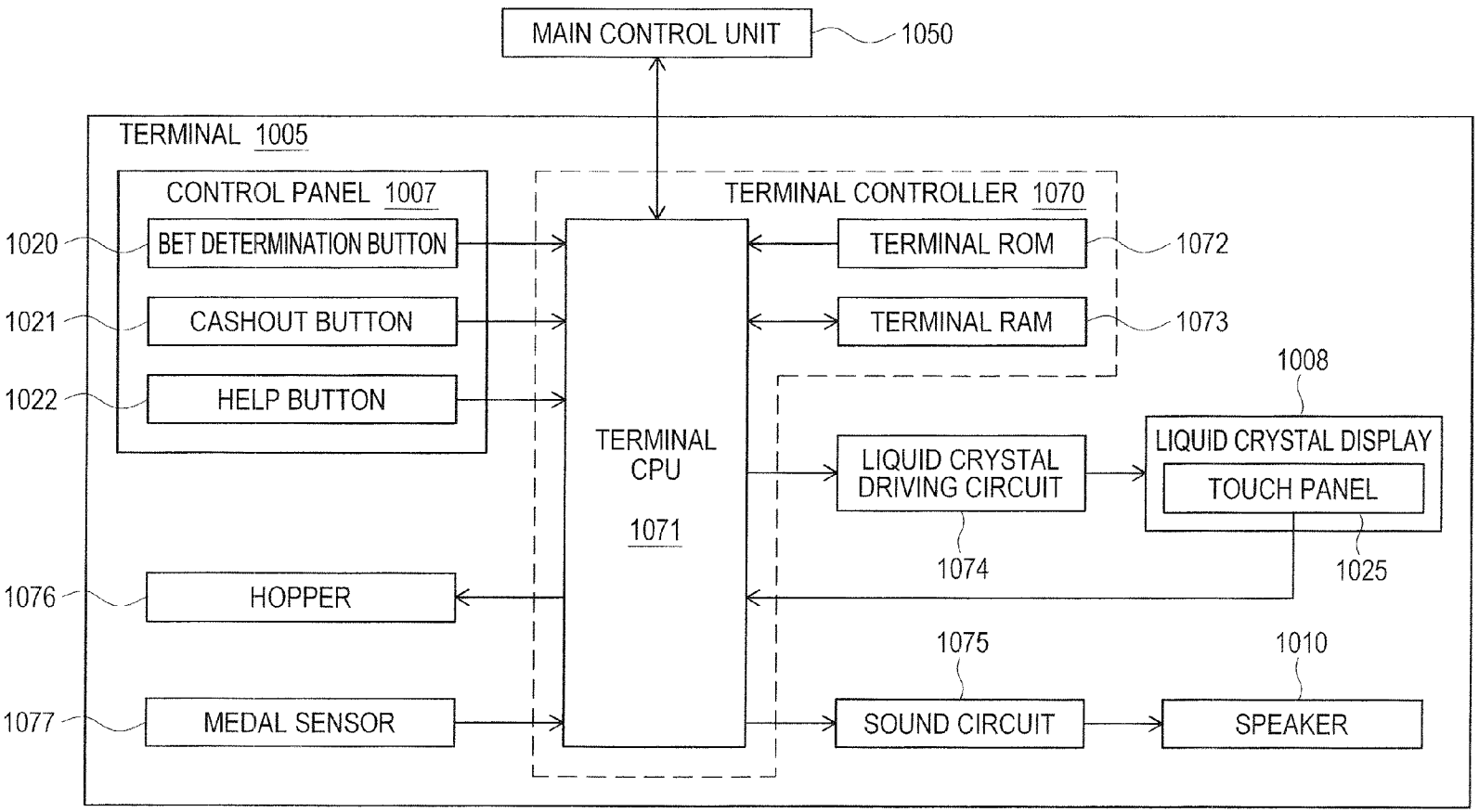
FIG. 18 is a block diagram showing an internal configuration of a terminal according to the second embodiment of the present invention.

Next, the terminals 1005 constituting the dice gaming machine 1001 will be described in detail while referring to the drawing. FIG. 18 is a block diagram showing the internal configuration of a terminal 1005.

The terminals 1005 constituting the dice gaming machine 1001 all have the same configuration. Accordingly, the internal configuration of one terminal 1005 will be described in detail. Description of the other terminals 1005 constituting the dice gaming machine 1001 will hereby be omitted.

As shown in FIG. 18, the terminal 1005 has a terminal controller 1070. This terminal controller 1070 controls the various functions of the terminal 1005. The terminal controller 1070 has a terminal CPU 1071, a terminal ROM 1072 and a terminal RAM 1073.

The terminal CPU 1071 is a central processing unit with respect to control made by the terminal controller 1070. Specifically, the terminal CPU 1071 plays a central role in the control with respect to the terminal 1005. More specifically, the terminal CPU 1071 controls the terminal 1005 by executing various types of programs stored in the terminal ROM 1072. For instance, the terminal CPU 1071 carries out control with respect to the dice game (for instance, control with respect to acceptance of bet operation and payment of payout) by executing the dice game execution process program (refer to FIG. 22 and FIG. 23) as will be described later.

The terminal ROM 1072 stores various types of programs to be executed in the terminal CPU 1071. More specifically, the terminal ROM 1072 stores dice game execution process programs (refer to FIG. 22 and FIG. 23) and the like. The terminal ROM 1072 stores various types of data tables. These data tables are referenced upon execution of the various programs.

The terminal ROM 1072 also stores a BIOS (Basic Input/Output System) and an authentication program. When power is applied to the dice gaming machine 1001, the terminal CPU 1071 executes the BIOS stored in the terminal ROM 1072. As a result, the terminal CPU 1071 initializes the peripheral devices constituting the terminals 1005. The terminal CPU 1071 authenticates the dice game execution process program and the like by executing an authentication program. At this time, the terminal CPU 1071 checks the presence of any alterations with respect to the dice game execution process program and the like. These processes are executed in an initial setting process executed at the time of power application.

The terminal RAM 1073 temporarily stores the results of the processing executed in the terminal CPU 1071. Specifically, the terminal RAM 1073 temporarily stores the processing results following execution of the above-mentioned programs (for instance, bet information based on the players' bet operation). The terminal RAM 1073 temporarily stores various types of information regarding the dice game (for instance, payout information transmitted from the main control unit 1050 and the like).

The terminal CPU 1071 is connected with the control panel 1007. As was described earlier, the control panel 1007 has a BET determination button 1020, a CASHOUT button 1021 and a HELP button 1022. Specifically, the BET determination button 1020, the CASHOUT button 1021 and the HELP button 1022 are each connected to the terminal CPU 1071. Accordingly, when a player operates the BET determination button 1020, the CASHOUT button 1021 and the HELP button 1022, a control signal based on each such operation can be inputted to the terminal CPU 1071. The terminal CPU 1071 can thus carry out control in accordance with the button that was operated, based on the operation signal thus inputted.

The terminal CPU 1071 is connected with the liquid crystal display 1008 through a liquid crystal driving circuit 1074. The liquid crystal driving circuit 1074 serves as a control circuit with respect to display on the liquid crystal display 1008. The liquid crystal driving circuit 1074 is made up of a program ROM, an image ROM, an image control CPU, a work RAM, a VDP (vide display processor) and a video RAM, etc. The program ROM stores various types of selection tables and image control programs regarding display on the liquid crystal display 1008. The image ROM stores dot data. This dot data is used for forming images to be displayed on the liquid crystal display 1008. The image control CPU determines images to be displayed on the liquid crystal display 1008 from the dot data stored in the image ROM, based on the parameters set in the terminal CPU 1071 and the image control program. The work RAM serves as a temporary storage device at the time the image control program is executed in the image control CPU. The VDP forms images in accordance with the display contents determined by the image control CPU. The VDP outputs the images thus formed to the liquid crystal display 1008. The video RAM serves as a temporary storage device at the time images are formed in the VDP.

As was described earlier, the liquid crystal display 1008 has a touch panel 1025 provided at a front face thereof. As is shown in FIG. 18, the terminal CPU 1071 is connected with the touch panel 1025. The touch panel 1025 detects the coordinate information corresponding to a portion touched by the player. Accordingly, the touch panel 1025 can identify a player's operation with respect to the touch panel 1025 based on the coordinate information. The operation information indicating a player's operation with respect to the touch panel 1025 is transmitted from the touch panel 1025 to the terminal CPU 1071.

In the dice gaming machine 1001 according to the second embodiment, when the betting board 1030A or the betting board 1030B is displayed on the liquid crystal display 1008 (refer to FIG. 19 and FIG. 20), the players select the bet areas 1035, etc. making up the betting board 1030A or 1030B and depress the unit BET button 1031 using the touch panel 1025. Accordingly, information with respect to the bet areas 1035, etc. thus selected and the unit BET button 1031 is transmitted from the touch panel 1025 to the terminal CPU 1071.

The terminal CPU 1071 is connected with the speaker 1010 through a sound circuit 1075. The sound circuit 1075 carries out control with respect to sound output from speaker 1010 based on the control signal transmitted from the terminal CPU 1071. The speaker 1010 outputs various effect sounds in accordance with the progress of the dice game. As a result, the dice gaming machine 1001 can execute effects in accordance with the progress of the dice game at each terminal 1005.

The terminal CPU 1071 is connected with a hopper 1076 and a medal sensor 1077. The hopper 1076 pays out medals to the cash out port 1009 based on the control signal from the terminal CPU 1071. The medal sensor 1077 detects the medals paid out from the hopper 1076. As a result, the terminal CPU 1071 can pay out a predetermined number of medals to the players by controlling the hopper 1076 and the medal sensor 1077.

Figure 19:
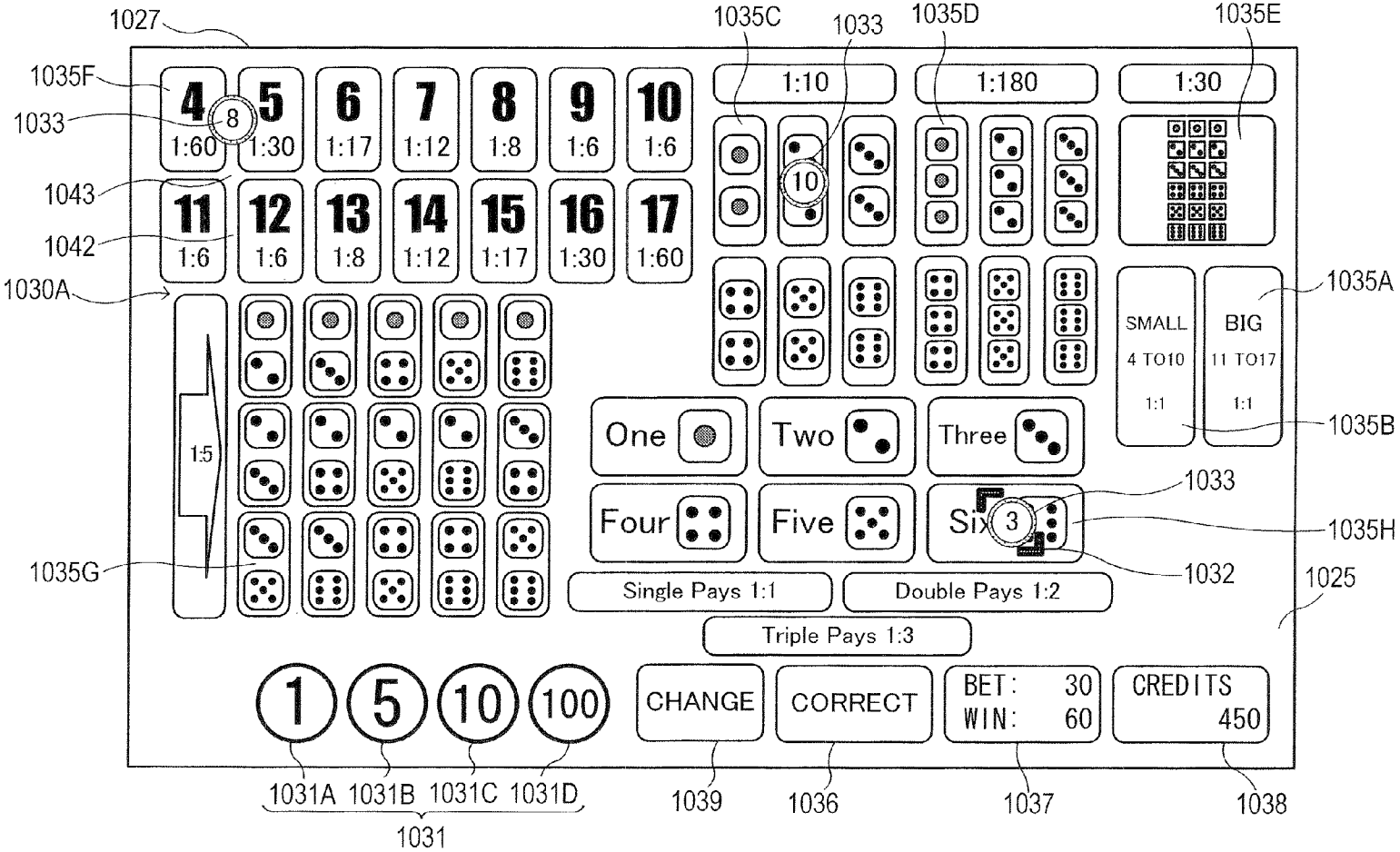
FIG. 19 is an exemplary view showing a first game screen including a betting board according to the second embodiment of the present invention.
Figure 20:
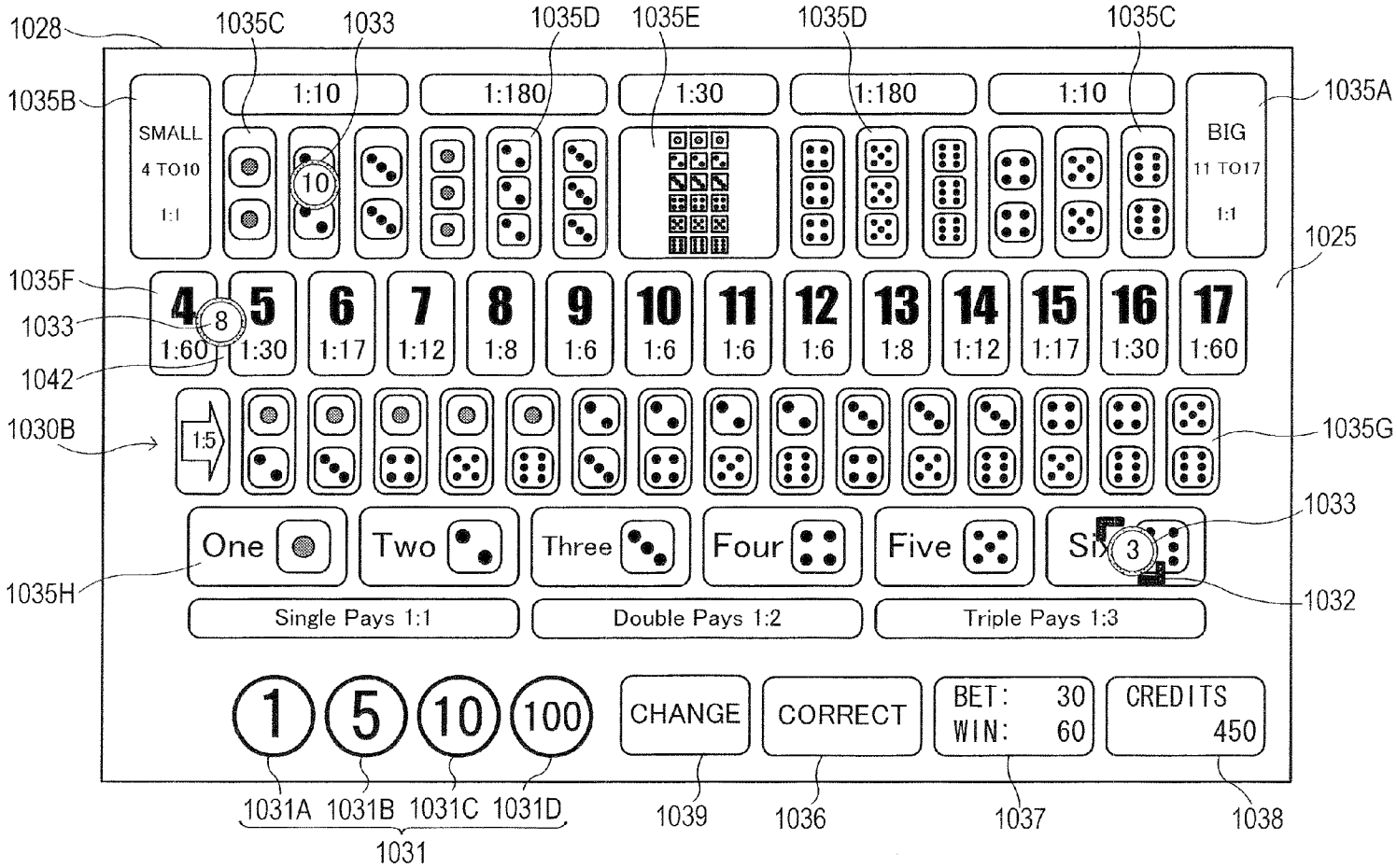
FIG. 20 is an exemplary view showing a second game screen including a betting board according to the second embodiment of the present invention.

Next, a detailed description will be given with respect to the game screen to be displayed on the liquid crystal display 1008 in the dice gaming machine 1001 according to the second embodiment, while referring to the drawings. FIG. 19 and FIG. 20 are an explanatory diagram showing one example of a game screen to be displayed on the liquid crystal display 1008.

As shown in FIG. 19 and FIG. 20, the game screen displayed on the liquid crystal display 1008 includes the betting board 1030A or the betting board 1030B. Here, when a dice game (e.g., Sic Bo) is played, the players bet gaming values with respect to the spots on the stopped three dice 1040. The betting board 1030A or 1030B is used by the player in betting the gaming values.

Here, FIG. 19 shows the first game screen 1027 including the betting board 1030A with its bet areas positioned specifically in the first position pattern. FIG. 20 shows the second game screen 1028 including the betting board 1030A with its bet areas positioned specifically in the second position pattern. The first position pattern represents a position pattern in which bet areas associated with the same winning condition are positioned so as to be in a matrix state. The second position pattern represents the same position pattern as the position pattern conventionally used at "Sic Bo". Each time a player depresses the CHANGE button 1039, the first game screen 1027 as shown in FIG. 19 and the second game screen 1028 as shown in FIG. 20 are switched over back and forth and displayed on the liquid crystal display 1008. Specifically, when the CHANGE button 1039 is depressed with the first game screen 1027 displayed on the liquid crystal display 1008, the second game screen 1028 is displayed on the liquid crystal display 1008 in place of the first game screen 1027. Conversely, when the CHANGE button 1039 is depressed with the second game screen 1028 displayed on the liquid crystal display 1008, the first game screen 1027 is displayed on the liquid crystal display 1008 in place of the second game screen 1028.

The betting boards 1030A and 1030B have a plurality of bet areas 1035. Each bet area 1035 is associated with a winning condition and a payout magnification ratio (i.e., base payout magnification ratio). The winning condition is the condition determined by the stopped three dice 1040. The base payout magnification ratio shows a payout amount to be paid out in return to the unit gaming value (specifically, one credit) bet, in a case where the winning condition of the bet area 1035 is satisfied.

In this embodiment, a payout magnification ratio (i.e., intermediate area payout magnification ratio) is provided to each of the intermediate areas 1042 and 1043 between and among the plurality of bet areas 1035. The intermediate area payout magnification ratio determines a payout amount to be paid out with respect to the unit gaming value (i.e., one credit) being bet, when the winning condition is satisfied in any bet area 1035 from amongst the plurality of bet areas 1035 forming the corresponding intermediate area 1042 or 1043.

More specifically, the each of the betting boards 1030A and 1030B has eight types of bet areas 1035. Specifically, each of the betting boards 1030A and 1030B has a big bet area 1035A, a small bet area 1035B, a specific double bet area 1035C, a specific triple bet area 1035D, an any triple bet area 1035E, a total bet area 1035F, a combination bet area 1035G and a number bet area 1035H.

The big bet area 1035A and the small bet area 1035B are bet areas in each of which a condition is defined with a range of values as a result of adding up the spots on the stopped dice 1040 (hereinafter referred to as total value). More specifically, the winning condition of the big bet area 1035A is that "the total value is in a range between 11 and 17". The base payout magnification ratio of the big bet area 1035A is set to 1:1 (two medals are paid out in return to a win with one medal placed as a bet). Alternatively, the winning condition of the small bet area 1035B is that "the total value is in a range between 4 and 10". The base payout magnification ratio of the small bet area 1035B is also set to 1:1.

The specific double bet area 1035C is a bet area in which a winning condition is defined with a combination of spots on the stopped dice 1040. More specifically, the winning condition of the specific double bet area 1035C is satisfied if "amongst the three dice 1040 which are stopped, the spots on two dice 1040 are the same, and the spots on these two dice 1040 correspond to specific spots". The betting board 1030 has six specific double bet areas 1035C. Accordingly, if the spots on two dice 1040 from amongst the three dice 1040 are "1,1", "2,2", "3,3" . . . or "6,6", the winning condition for one specific double bet area 1035C is satisfied (refer to FIG. 19 and FIG. 20). The base payout magnification ratio of each specific double bet area 1035C is set to 1:10.

The specific triple bet area 1035D is a bet area in which a winning condition is defined with a combination of spots on the stopped three dice 1040. More specifically, the winning condition of the specific triple bet area 1035C is satisfied if "the spots on the three dice 1040 which are stopped are the same and the spots on the three dice 1040 correspond to specific spots". The betting board 1030 has six specific triple bet areas 1035D. Accordingly, if the spots on the three dice 1040 are "1,1,1", "2,2,2", "3,3,3" . . . or "6,6,6", the winning condition for one specific triple bet area 1035D is satisfied (refer to FIG. 19 and FIG. 20). The base payout magnification ratio of each specific triple bet area 1035C is set to 1:180.

The any triple bet area 1035E is a bet area in which a winning condition is defined with a combination of the spots on the stopped three dice 1040. More specifically, the winning combination of the any triple bet area 1035E is satisfied if "the spots on the stopped dice 1040 are all the same". Accordingly, if the spots on the three dice 1040 are "1,1,1", "2,2,2", "3,3,3" or "6,6,6", the winning combination of the any triple bet area 1035E is satisfied (refer to FIG. 19 and FIG. 20). The base payout magnification ratio of the any triple bet area 1035E is set to 1:30.

The total bet area 1035F is a bet area in which a winning condition is defined with a total value of the spots on the stopped three dice 1040. More specifically, the winning combination of the total bet area 1035F is satisfied if "the total value is a specific value". As shown in FIG. 19 and FIG. 20, the betting board 1030 has fourteen total bet areas 1035F. Specifically, the betting board 1030 has a total bet area 1035F corresponding to each total value "4", "5" . . . "17". As shown in FIG. 19 and FIG. 20, the base payout magnification ratio of each total bet area 1035F is set in accordance with the appearance frequency of the total value for each winning condition. For instance, if the winning condition for the total value "16" is the total bet area 1035F thus set, the base payout magnification ratio is 1:30.

The combination bet area 1035G is a bet area in which a winning condition is defined with a combination of the spots on the stopped dice 1040. More specifically, the winning condition of the combination bet area 1035G is satisfied if "the spots on two dice 1040 from amongst the stopped three dice 1040 correspond to a specific combination". As shown in FIG. 19 and FIG. 20, the betting board 1030 has fifteen combination bet areas 1035G. The base payout magnification ratio for the combination bet area 1035G is set to 1:5.

The combination for the case that the spots on two dice 1040 are the same is excluded from the combination bet area 1035G.

The number bet area 1035H is a bet area in which a winning condition is defined with the spots' numbers on the dice 1040. More specifically, the winning combination of the number bet area 1035H is satisfied if "a specific spot is included in the spots on the stopped three dice 1040". As shown in FIG. 19 and FIG. 20, the betting board 1030 has six number bet areas 1035H. One number bet area 1035H corresponds to any of "1", "2" . . . "6". The base payout magnification ratio of the number bet area 1035H is set to "1:1", "1:2", "1:3", in accordance with the number of dices showing the spots corresponding to the winning combination.

Figure 21:
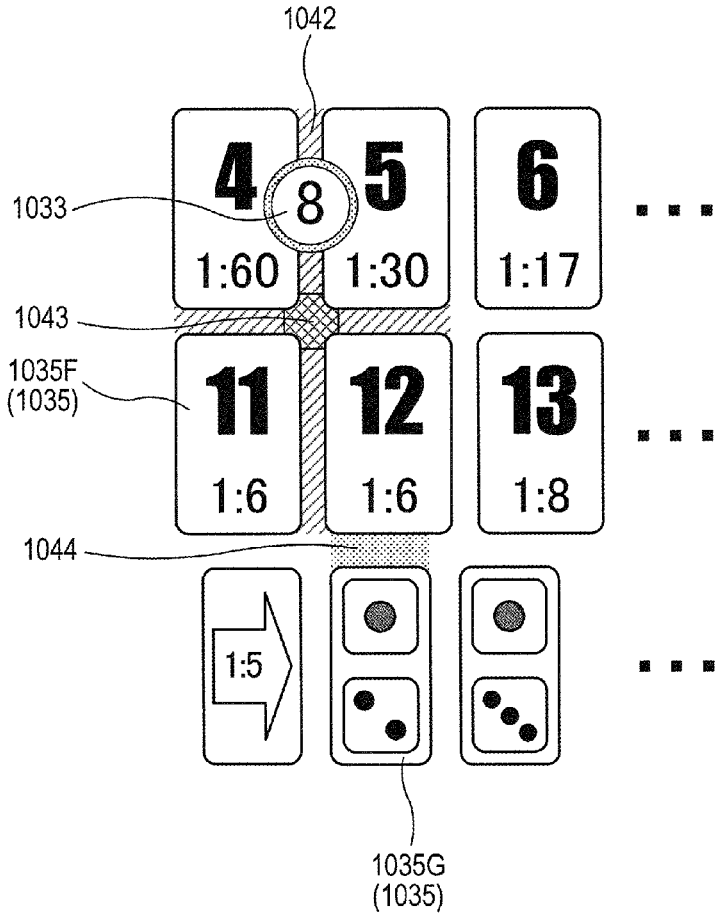
FIG. 21 is a view showing a first intermediate area and a second intermediate area formed between and among bet areas in the dice gaming machine according to the second embodiment of the present invention.

The intermediate area payout magnification ratio which is set for an intermediate area 1042 or 1043 between or among a plurality of bet areas is decided in accordance with the base payout magnification ratios of the plurality of bet areas 1035 forming the intermediate area 1042 or 1043. In this embodiment, an intermediate area 1042 or 1043 formed only by the bet areas 1035 associated with a same type of winning condition (e.g., total bet areas 1035F) is targeted as the intermediate area 1042 or 1043 on which a bet is accepted. Accordingly, as is illustrated in FIG. 21, a bet is accepted on the first intermediate area 1042 located between a total bet area 1035F whose winning condition is satisfied if the total of the spot numbers of stopped dice 1040 is "4", and a total bet area 1035F whose winning condition is satisfied if the total of the spot numbers of stopped dice 1040 is "5". Also, as is illustrated in FIG. 21, a bet is accepted on the second intermediate area 1043 located among a total bet area 1035F whose winning condition is satisfied if the total of the spot numbers of stopped dice 1040 is "4", a total bet area 1035F whose winning condition is satisfied if the total of the spot numbers of stopped dice 1040 is "5", a total bet area 1035F whose winning condition is satisfied if the total of the spot numbers of stopped dice 1040 is "11", and a total bet area 1035F whose winning condition is satisfied if the total of the spot numbers of stopped dice 1040 is "12". In contrast, a bet is not accepted on an intermediate area 1044 located between a total bet area 1035F whose winning condition is satisfied if the total of the spot numbers of stopped dice 1040 is "12", and a combination bet area 1035G whose winning condition is satisfied if the spots on two dice 1040 from amongst the stopped three dice 1040 correspond to a combination of "one" and "two".

An intermediate area payout magnification ratio to be set with respect to the intermediate area 1042 or 1043 between or among a plurality of bet areas is decided in accordance with either method of method (A) or method (B).

(A) In the case where all bet areas forming an intermediate area 1042 or 1043 have the same base payout magnification ratio (for instance, in the case where combination bet areas 1035G form an intermediate area 1042 or 1043, and the like):

In such a case, the intermediate area payout magnification ratio of the intermediate area 1042 or 1043 is obtained through dividing the base payout magnification ratio of each bet area 1035 forming the intermediate area 1042 or 1043 by the number of bet areas 1035 forming the intermediate area 1042 or 1043.

Figure 22:
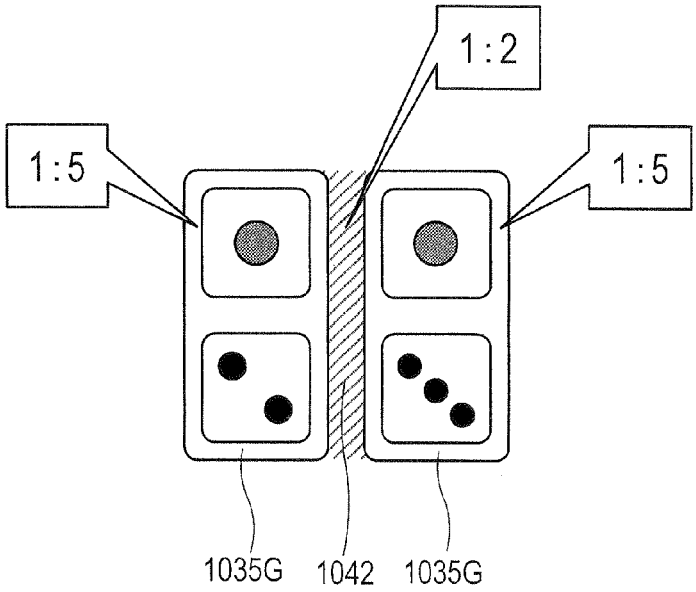
FIG. 22 is an exemplary diagram showing one example of an intermediate area payout magnification ratio set at the dice gaming machine according to the second embodiment of the present invention.

Here is explained an example of an intermediate area payout magnification ratio set for a first intermediate area 1042 between combination bet areas 1035G as shown in FIG. 22.

As shown in FIG. 22, the base payout magnification ratio is set to "1:5" in a combination bet area 1035G whose winning condition is that the spots on two dice 1040 from amongst the stopped three dice 1040 correspond to a combination of "one" and "two". Similarly, the base payout magnification ratio is set to "1:5" in a combination bet area 1035G whose winning condition is that the spots on two dice 1040 from amongst the stopped three dice 1040 correspond to a combination of "one" and "three".

Accordingly, the intermediate area payout magnification ratio of the first intermediate area 1042 is set to "1:2".

In this case, the expected value obtained when a certain amount of gaming value is bet on the first intermediate area 1042 is the same as the expected value obtained when the certain amount is divided by the number of the bet areas 1035 forming the first intermediate area 1042 into equal amounts and the equal amounts are respectively bet on all the bet areas 1035 forming the first intermediate area 1042.

Here, the expected value of a bet area 1035 is calculated through multiplying the winning probability of the bet area 1035 by the amount of unit gaming value (specifically, "bet amount: 1") and the payout magnification ratio of the bet area 1035. The winning probability of the bet area 1035 is the probability that the winning condition of the bet area 1035 will be satisfied in one dice game. For instance, the winning probability of a certain specific triple bet area 1035D is "1/216".

Also, the expected value of an intermediate area 1042 or 1043 is calculated through multiplying the probability that the winning condition of any of the bet areas 1035 forming the intermediate area 1042 or 1043 will be satisfied by the amount of unit gaming value (specifically, "bet amount: 1") and the payout magnification ratio of the intermediate area 1042 or 1043.

(B) In the case where the bet areas forming an intermediate area 1042 or 1043 have different base payout magnification ratios (for instance, in the case where total bet areas 1035F form the intermediate area 1042 or 1043, and the like).

In such a case, the intermediate area payout magnification ratio of the intermediate area 1042 or 1043 is set so that the expected value of the intermediate area 1042 or 1043 is between the maximum value and the minimum value from amongst the expected values of the respective bet areas 1035 forming the intermediate area 1042 or 1043, and so that, at the same time, the expected value obtained when a certain amount of gaming value is bet on the intermediate area 1042 or 1043 is higher than the expected value obtained when the certain amount is divided by the number of the bet areas 1035 forming the intermediate area 1042 or 1043 into equal amounts and the equal amounts are respectively bet on all the bet areas 1035 forming the intermediate area 1042 or 1043.

Figure 23:
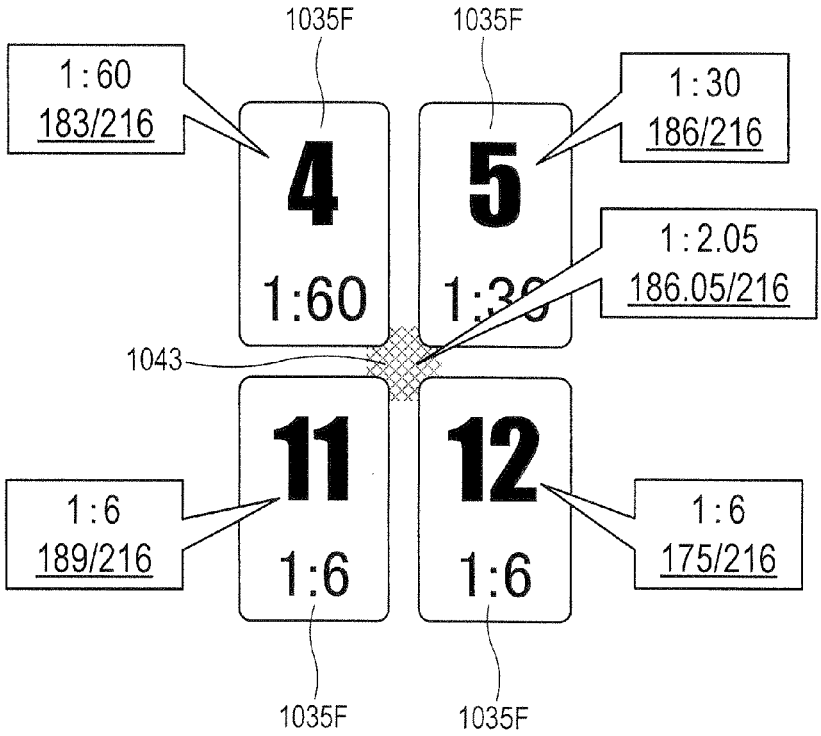
FIG. 23 is an exemplary diagram showing one example of an intermediate area payout magnification ratio set at the dice gaming machine according to the second embodiment of the present invention.

Here is explained an example of an intermediate area payout magnification ratio set for a second intermediate area 1043 located among a total bet area 1035F whose winning condition is satisfied if the total of the spot numbers of stopped dice 1040 is "4", a total bet area 1035F whose winning condition is satisfied if the total of the spot numbers of stopped dice 1040 is "5", a total bet area 1035F whose winning condition is satisfied if the total of the spot numbers of stopped dice 1040 is "11" and a total bet area 1035F whose winning condition is satisfied if the total of the spot numbers of stopped dice 1040 is "12" as shown in FIG. 23.

As shown in FIG. 23, "1:60" is set to the base payout magnification ratio of the total bet area 1035F whose winning condition is satisfied if the total of the spot numbers of stopped dice 1040 is "4". The probability that the total of the spot numbers of stopped dice becomes "4" is 3/216.

Accordingly, the following formula (6) is used for the calculation of the expected value $F_4$ of the total bet area 1035F whose winning condition is satisfied if the total of the spot numbers of stopped dice 1040 is "4":

$$F_4=3/216\times61=183/216 \tag{6}$$

Meanwhile, "1:30" is set to the base payout magnification ratio of the total bet area 1035F whose winning condition is satisfied if the total of the spot numbers of stopped dice 1040 is "5". The probability that the total of the spot numbers of stopped dice becomes "5" is 6/216.

Accordingly, the following formula (7) is used for the calculation of the expected value $F_5$ of the total bet area 1035F whose winning condition is satisfied if the total of the spot numbers of stopped dice 1040 is "5":

$$F_5=6/216\times31=186/216 \tag{7}$$

In addition, "1:6" is set to the base payout magnification ratio of the total bet area 1035F whose winning condition is satisfied if the total of the spot numbers of stopped dice 1040 is "11". The probability that the total of the spot numbers of stopped dice becomes "11" is 27/216.

Accordingly, the following formula (8) is used for the calculation of the expected value $F_6$ of the total bet area 1035F whose winning condition is satisfied if the total of the spot numbers of stopped dice 1040 is "11":

$$F_6=27/216\times7=189/216 \tag{8}$$

Further, "1:6" is set to the base payout magnification ratio of the total bet area 1035F whose winning condition is satisfied if the total of the spot numbers of stopped dice 1040 is "12". The probability that the total of the spot numbers of stopped dice becomes "12" is 25/216.

Accordingly, the following formula (9) is used for the calculation of the expected value $F_7$ of the total bet area 1035F whose winning condition is satisfied if the total of the spot numbers of stopped dice 1040 is "12":

$$F_7=25/216\times7=175/216 \tag{9}$$

A value which satisfies the following conditional expressions (10) and (11) is the expected value $F_8$ of the second intermediate area 1043 among the total bet area 1035F whose winning condition is satisfied if the total of the spot numbers of stopped dice 1040 is "4", the total bet area 1035F whose winning condition is satisfied if the total of the spot numbers of stopped dice 1040 is "5", the total bet area 1035F whose winning condition is satisfied if the total of the spot numbers of stopped dice 1040 is "11" and the total bet area 1035F whose winning condition is satisfied if the total of the spot numbers of stopped dice 1040 is "12":

$$F_7 \leqq F_8 \leqq F_6 \tag{10}$$

$$F_8 \geqq (F_4+F_5+F_6+F_7)/4 \tag{11}$$

Here, the above conditional expression (10) defines the condition that the expected value $F_8$ of the second intermediate area 1043 lies between the minimum value $F_7$ and the maximum value $F_8$ from amongst the expected values of the respective bet areas 1035F forming the second intermediate area 1043.

Also, the above conditional expression (11) defines the condition that the expected value obtained when a certain amount of gaming value is bet on the second intermediate area 1043 is higher than the expected value obtained when the certain amount is divided by the number of the bet areas 1035 forming the second intermediate area 1043 into equal amounts and the equal amounts are respectively bet on all the bet areas 1035 forming the second intermediate area 1043.

Further, the intermediate area payout magnification ratio X of the second intermediate area 1043 is calculated based on the value $F_8$ which satisfies both of the conditional expressions (10) and (11) and the probability that one of the bet areas 1035 forming the second intermediate area 1043 satisfies the winning condition. Here, the probability that the total of the spot numbers of stopped dice 1040 is either "4", "6", "11" or "12" is 61/216. Accordingly, the intermediate area payout magnification ratio X of the second intermediate area 1043 as shown in FIG. 23 is calculated, specifically, using the following formula (12):

$$X=F_8/(61/216) \quad (12)$$

Here, if 186.05/216 is selected as the value of $F_8$ which satisfies both of the conditional expressions (10) and (11), the intermediate area payout magnification X of the second intermediate area 1043 as shown in FIG. 23 is "X=3.05".

Accordingly, "1:2.05" is set to the intermediate area payout magnification ratio of the second intermediate area 1043.

The game screens 1027 and 1028 can include a cursor 1032 and a chip mark 1033. The cursor 1032 and the chip mark 1033 are displayed on the betting boards 1030A and 1030B in accordance with a player's operation. The cursor 1032 shows the bet area 1035, etc. which is currently selected by the player. The chip mark 1033 shows the amount of gaming values bet with respect to the bet area 1035, etc. (hereinafter referred to as bet amount). As shown in FIG. 19 and FIG. 20, the chip mark 1033 shows the above-mentioned bet amount through the number displayed at the center of the chip mark 1033. The chip mark 1033 is displayed on the bet area 1035, etc. Specifically, the chip mark indicates the bet area 1035, etc. onto which the bet is made through the location of its display.

Further, as shown in FIG. 19 and FIG. 20, the game screens 1027 and 1028 include a unit BET button 1031, a CORRECT button 1036, a payout result display portion 1037 and a credit amount display portion 1038.

The unit BET button 1031 is formed at a lower left side of the betting boards 1030A and 1030B. The unit BET button 1031 is used to set the bet amount with respect to the bet area 1035, etc. selected by the player.

As shown in FIG. 19 and FIG. 20, the unit BET button 1031 is made up of 1 BET button 1031A, 5 BET button 1031B, 10 BET button 1031C and 100 BET button 1031D. The 1 BET button 1031A is operated by the player to increase the bet amount with respect to the bet area 1035, etc. selected by the player by "1". The 5 BET button 1031B is operated by the player to increase the bet amount with respect to the bet area 1035, etc. selected by the player by "5".

The 10 BET button 1031C is operated by the player to increase the bet amount with respect to the bet area 1035, etc. selected by the player by "10". The 100 BET button 1031D is operated by the player to increase the bet amount with respect to the bet area 1035, etc. selected by the player by "100".

Each time the player carries out such operation, the unit BET button 1031 adds a bet amount in accordance with such operation to the current bet amount.

The CORRECT button 1036 is operated to cancel the bet area 1035, etc. already selected and the setting of the bet amount. If selection of the bet area 1035, etc. and setting of the bet amount are incorrect, the player can correct the bet area 1035, etc. and the bet amount by operating this CORRECT button 1036.

The payout result display portion 1037 displays the total bet amount in the previous game and the payout amount in the previous game (the payout credit amount).

The credit amount display portion 1038 displays the credit amount possessed by the player. The display contents of the credit amount display portion 1038 are updated based on the bet with respect to the bet area 1035, etc. and award of the payout in the dice game.

The CHANGE button 1039 is operated to change the position pattern of the bet areas 1035. When a player operates the CHANGE button 1039 with the betting board 1030A displayed on the liquid crystal display 1008, the betting board 1030B (FIG. 20) is displayed on the liquid crystal display 1008 in place of the betting board 1030A (FIG. 19). Conversely, when a player operates the CHANGE button 1039 with the betting board 1030B displayed on the liquid crystal display 1008, the betting board 1030A is displayed on the liquid crystal display 1008 in place of the betting board 1030B.

Next, the bet operation carried out by the player using the game screen will be described. As was described earlier, the touch panel 1025 is installed at a front face of the liquid crystal display 1008. The touch panel 1025 transmits the coordinate information corresponding to the portion touched by the player to the terminal CPU 1071. Accordingly, if the game screen is displayed on the liquid crystal display 1008, the player can select the bet area 1035, etc. and set the bet amount using the touch panel 1025.

More specifically, the player first touches with his/her finger, etc. the touch panel 1025 at the portion corresponding to the desired bet area 1035 or the touch panel 1025 at the portion corresponding to the desired intermediate area 1042 or 1043. As a result, the player selects the desired bet area 1035, etc. At this time, the cursor 1032 is displayed on the bet area 1035 or the intermediate area 1042 or 1043 thus selected. Thereafter, the player touches with his/her finger, etc. the touch panel 1025 at the portion corresponding to the unit BET button 1031. As a result, the player selects the bet amount with respect to the selected bet area 1035, etc. Once the bet amount is selected, the chip mark 1033 is displayed on the bet area 1035 or the intermediate area 1042 or 1043.

Figure 24:
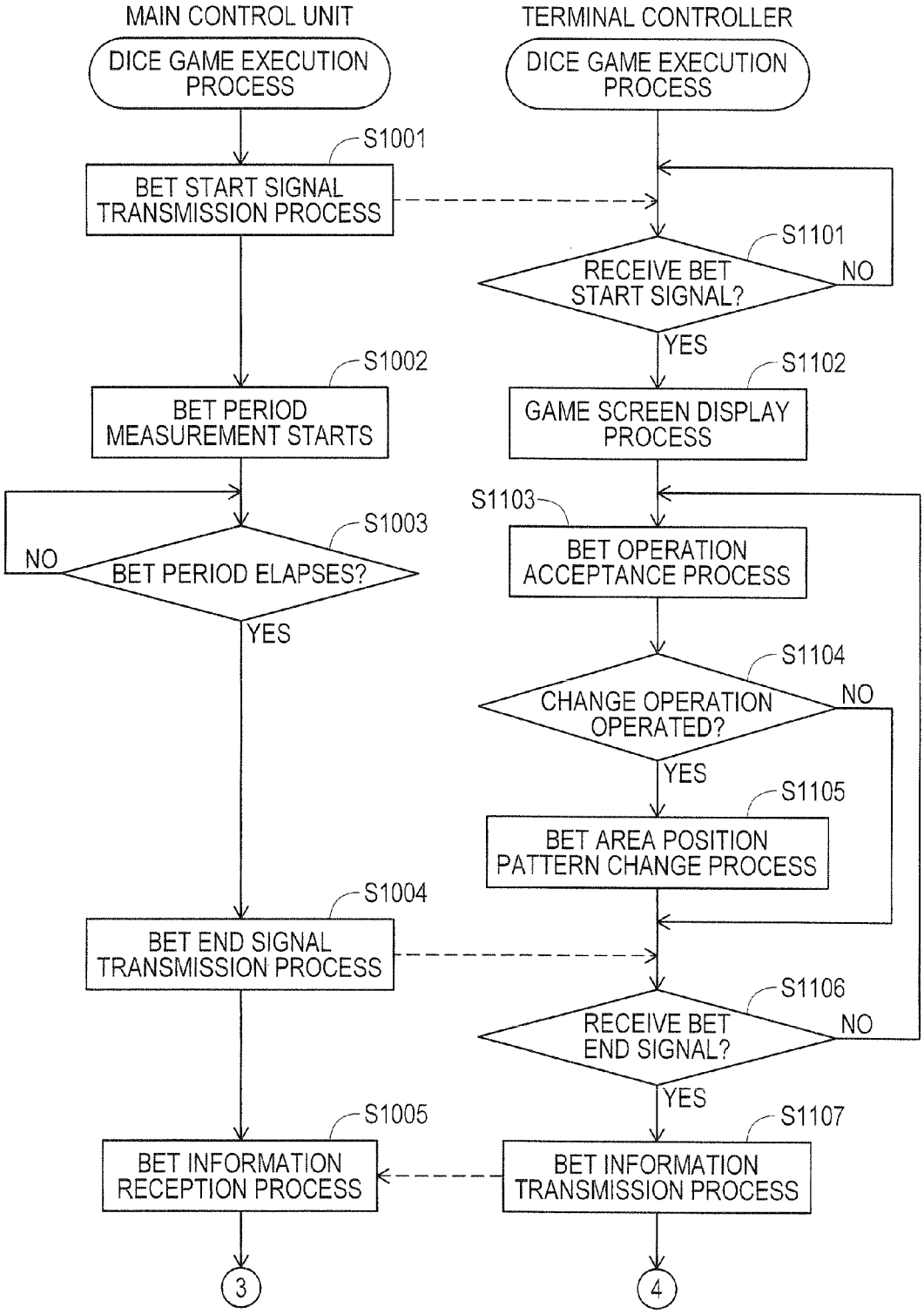
FIG. 24 is a flow chart (3) of a dice game execution process program according to the second embodiment of the present invention.
Figure 25:
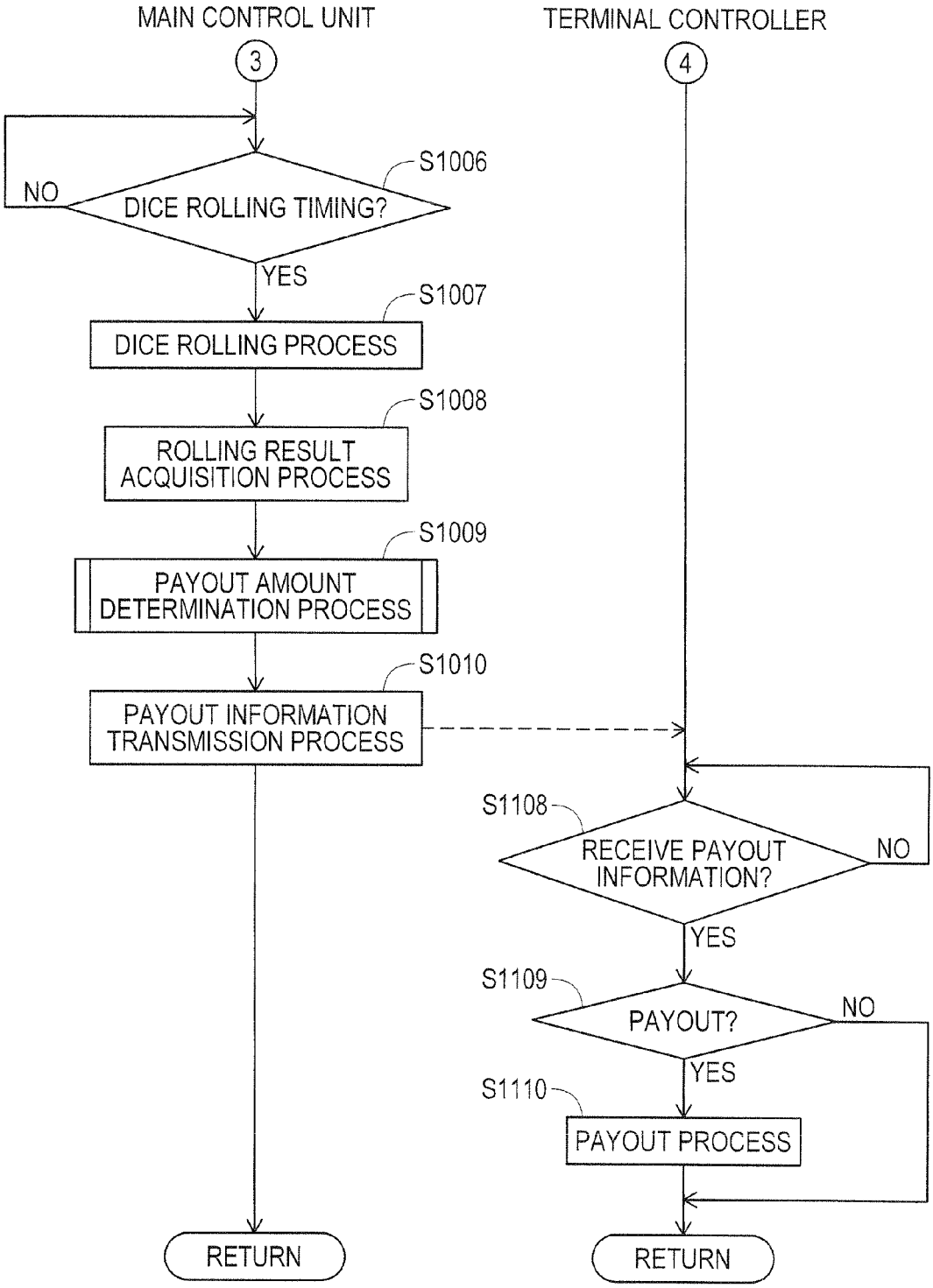
FIG. 25 is a flow chart (4) of the dice game execution process program according to the second embodiment of the present invention.

Next, a dice game execution process program to be executed in the dice gaming machine 1001 according to the second embodiment will be described in detail while referring to the drawings. FIG. 24 and FIG. 25 are flow charts of the dice game execution process program.

The initial setting process executed in the main control unit 1050 and the initial setting process executed in the terminal controller 1070 of each terminal 1005 are executed prior to the dice game execution process program. Specifically, the main control unit 1050 and the terminal controller 1070 end initialization of the peripheral devices and the program authentication process. These initial setting processes are heretofore known in the art. Therefore, description of the contents of such processes is hereby omitted.

First, the dice game execution process program in the main control unit 1050 will be described in detail.

Once execution of the dice game execution process program is started, the CPU 1051 first executes the bet start signal transmission process (S1001). In the bet start signal transmission process (S1001), the CPU 1051 transmits the bet start signal to the terminals 1005 through the communication interface 1055. The bet start signal serves to instruct start of the bet period in the terminals 1005. The bet period is the period for accepting the players' bets for the gaming values with respect to the bet areas 1035 at each terminal 1005. After the bet start signal is transmitted to the terminals 1005, the CPU 1051 shifts the process to S1002.

Once the bet start signal is received, the terminal CPU 1071 executes the game screen display process (S1102) and the bet operation acceptance process (S1103). This will be described in more detail later.

After shifting to S1002, the CPU 1051 starts measuring the bet period. More specifically, the CPU 1051 transmits the control signal to the timer 1054. As a result, the timer 1054 starts measurement. After the control signal is transmitted to the timer 1054, the CPU 1051 shifts the process to S1003.

At S1003, the CPU 1051 judges whether the bet period has lapsed. More specifically, the CPU 1051 references the measurement results of the timer 1054. The CPU 1051 judges whether the predetermined period (e.g., bet period) has lapsed based on the measurement result of the timer 1054. If the bet period has lapsed (S1003: YES), the CPU 1051 shifts the process to S1004. Alternatively, if the bet period has not lapsed yet (S1003: NO), the CPU 1051 puts the process in stand-by until the bet period lapses.

At S1004, the CPU 1051 executes the bet end signal transmission process. In the bet end signal transmission process (S1004), the CPU 1051 transmits a bet end signal to the terminals 1005. The bet end signal serves to instruct ending of the bet period in each terminal 1005. In other words, the bet end signal means that acceptance of bets for gaming values in the terminal 1005 is ended. After the bet end signal is transmitted to each terminal 1005, the CPU 1051 shifts the process to S1005.

Once the bet end signal is received, the terminal CPU 1071 ends the bet operation acceptance process (S1103). Accordingly, the terminal 1005 ends acceptance of bets with respect to the bet areas 1035. Thereafter, the terminal CPU 1071 transmits the bet information based on the bet operation carried out in the bet operation acceptance process (S1103) to the main control unit 1050 (S1107). This bet information includes information showing the bet area 1035 on which the gaming value has been bet and information showing the bet amount bet on the bet area 1035 in question. The bet information includes identification information showing the terminal 1005 from which the bet information is transmitted.

After shifting to S1005, the CPU 1051 executes the bet information reception process. In the bet information reception process (S1005), the CPU 1051 receives the bet information transmitted from each terminal 1005 through the communication interface 1055. The CPU 1051 stores the bet information thus received in the RAM 1053. At this time, the CPU 1051 classifies the bet information for each terminal 1005 based on the identification information included in the bet information. Once the bet information reception process (S1005) ends, the CPU 1051 shifts the process to S1006.

At S1006, the CPU 1051 judges whether the dice rolling timing has arrived. The dice rolling timing shows the timing at which rolling of the three dice 1040 is started in the dice rolling device 1003. More specifically, at S1006, the CPU 1051 first references the measurement results of the timer 1054. Specifically, the CPU 1051 carries out the judgment process at S1006 based on the measurement result of timer 1054. When the dice rolling timing arrives (S1006: YES), the CPU 1051 shifts the process to S1007. Alternatively, if the dice rolling timing has not yet arrived (S1006: NO), the CPU 1051 puts the process in stand-by until such dice rolling timing arrives.

At S1007, the CPU 1051 executes a dice rolling process. In this dice rolling process (S1007), the CPU 1051 transmits a control signal to the dice rolling device 1003. As a result, the dice rolling motor 1012 is driven and controlled. Accordingly, the three dice 1040 are rolled inside the dice rolling device 1003. The three dice 1040 which have been rolled are then stopped on the dice rolling board 1011. Once the dice rolling process ends, the CPU 1051 shifts the process to S1008.

At S1008, the CPU 1051 executes a rolling result acquisition process. In this rolling result acquisition process (S1008), the CPU 1051 acquires the rolling result information showing the spots on the stopped three dice 1040, by controlling the rolling result detection device 1015 of the dice rolling device 1003. More specifically, the CPU 1051 transmits the control signal to the dice rolling device 1003. Upon receiving the control signal, the dice rolling device 1003 acquires an image with an imaging device provided in the dice rolling device 1003. The acquired image includes the image of the stopped three dice 1040 on the dice rolling board 1011. Thereafter, the dice rolling device 1003 carries out a predetermined image process with respect to the acquired image by controlling the rolling result detection device 1015. As a result, the dice rolling device 1003 can identify the spots on the three dice 1040 which are stopped on the dice rolling board 1011. The dice rolling device 1003 generates rolling result information showing the spots on the three dice 1040 thus identified. The dice rolling device 1003 then transmits the rolling result information thus generated to the CPU 1051. Once the rolling result information acquired from the dice rolling device 1003 is stored in the RAM 1053, the CPU 1051 shifts the process to S1009.

Figure 26:
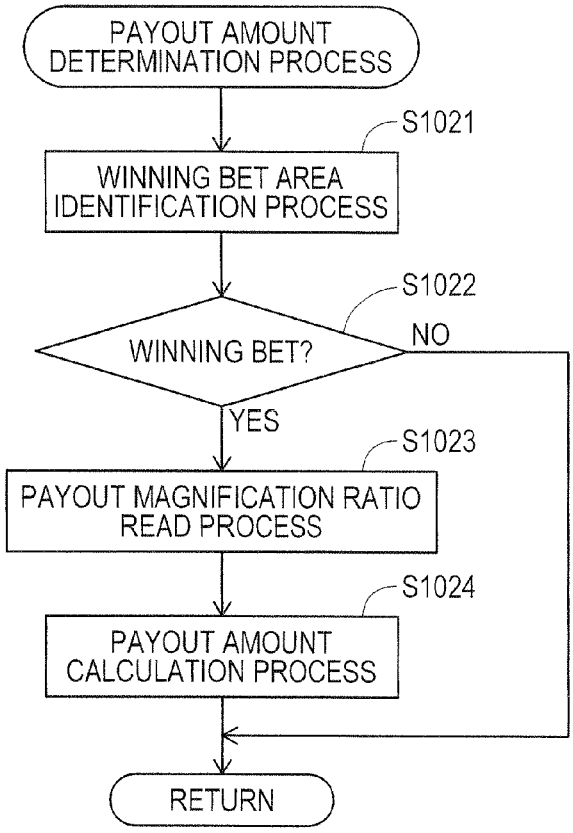
FIG. 26 is a flow chart of a payout amount determination process program according to the second embodiment of the present invention.

After shifting to S1009, the CPU 1051 executes a payout amount determination process (FIG. 26). In this payout amount determination process (S1009), the CPU 1051 executes a payout amount determination process program (refer to FIG. 26) as will be described later. In this payout amount determination process, the CPU 1051 calculates the payout amount of each terminal 1005 based on the rolling result information and the bet information of each terminal 1005. The contents of the payout amount determination process (S1009) will next be described in detail. Once the payout amount determination process ends, the CPU 1051 shifts the process to S1010.

At S1010 the CPU 1051 executes a payout information transmission process. In this payout information transmission process (S1010), the CPU 1051 transmits the payout information to each terminal 1005 through the communication interface 1055. This payout information shows the payout amount calculated in the payout amount determination process (S1009). After transmitting the payout information to each terminal 1005, the CPU 1051 ends the payout information transmission process. The CPU 1051 then ends the dice game execution process program in the main control unit 1050.

Once execution of the dice game execution process program is ended, the CPU 1051 restarts execution of the dice game execution process program. Specifically, the CPU 1051 repeatedly executes the dice game execution process program while power is being supplied to the dice gaming machine 1001.

Next, the dice game execution process program at each terminal 1005 will next be described in detail.

Upon starting the dice game execution process program, the terminal CPU 1071 first judges whether the bet start signal has been received (S1101). As was described earlier, the bet start signal serves to instruct start of the bet period in the dice gaming machine 1001. The bet start signal is transmitted from the main control unit 1050 to each terminal 1005 (S1001). If the bet start signal is received (S1101: YES), the terminal CPU 1071 shifts the process to S1102. As a result, the bet period in each terminal 1005 is started. Alternatively, if the bet start signal has not yet been received (S1101: NO), the terminal CPU 1071 puts the process in stand-by until the bet start signal is received.

After shifting to S1102, the terminal CPU 1071 executes a game screen display process. In this game screen display process (S1102), the terminal CPU 1071 transmits the control signal to the liquid crystal driving circuit 1074. The second game screen 1028 is displayed on the liquid crystal display 1008 based on the control of the liquid crystal driving circuit 1074 (refer to FIG. 20). Once the second game screen 1028 is displayed on the liquid crystal display 1008, the terminal CPU 1071 shifts the process to S1103.

At S1103, the terminal CPU 1071 executes a bet operation acceptance process. In this bet operation acceptance process (S1103), the terminal CPU 1071 accepts a player's operation using the touch panel 1025. More specifically, the terminal CPU 1071 carries out various types of controls corresponding to a player's operation based on the operation signal transmitted from the touch panel. Such controls include control with respect to selecting the bet area 1035, etc., control with respect to setting the bet amount corresponding to the selected bet area 1035, etc. and control corresponding to operation of the CORRECT button 1036.

If the bet area 1035 is selected and the bet amount with respect to the selected area 1035, etc. is set, the terminal CPU 1071 stores the bet information in the terminal RAM 1073. The bet information includes information with respect to the selected bet area 1035, etc. and information showing the bet amount of the bet area 1035, etc.

At S1104, the terminal CPU 1071 judges whether the CHANGE button has been operated or not. If it is judged that the CHANCE button 1039 has been operated (S1104: YES), the terminal CPU 1071 shifts the process to S1105. Contrarily, if it is judged that the CHANGE button 1039 has not been operated (S1104: NO), the terminal CPU 1071 shifts the process to S1106.

At S1104, the terminal CPU 1071 changes the position pattern of the bet areas 1035 positioned in the betting board displayed on the liquid crystal display 1008. Specifically, when the CHANGE button 1039 is operated with the first game screen 1027 displayed on the liquid crystal display 1008, the second game screen 1028 including the betting board 1030B is displayed on the liquid crystal display 1008 in place of the first game screen 1027 including the betting board 1030A. Meanwhile, when the CHANGE button 1039 is operated with the second game screen 1028 displayed on the liquid crystal display 1008, the first game screen 1027 is displayed on the liquid crystal display 1008 in place of the second game screen 1028.

In the next step S1106, the terminal CPU 1071 judges whether the bet end signal has been received. As was described earlier, the bet end signal shows the end of the bet period. Specifically, reception of the bet end signal means that acceptance of bets in the current dice game ends. The bet end signal is transmitted from the main control unit 1050 (S1004). If the bet end signal is received (S1106: YES), the terminal CPU 1071 shifts the process to S1107. Alternatively, if the bet end signal has not yet been received (S1106: NO), the terminal CPU 1071 returns the process to the bet operation acceptance process (S1103). Thus, the player at each terminal can bet a gaming value in the current game until the end of the bet period.

After shifting to S1107, the terminal CPU 1071 executes a bet information transmission process. In this bet information transmission process (S1107), the terminal CPU 1071 transmits the bet information stored in the terminal RAM 1073 to the main control unit 1050. Here, the terminal CPU 1071 adds identification information showing the terminal 1005 in question to the bet information. After receiving the bet information including the identification information, the terminal CPU 1071 shifts the process to S1108.

At S1108, the terminal CPU 1071 judges whether payout information has been received. The payout information shows the payout amount to be paid out at the corresponding terminal 1005. The payout information is transmitted from the main control unit 1050 (S1010). If it is judged that the payout information has been received (S1108: YES), the terminal CPU 1071 shifts the process to S1109. Alternatively, if it is judged that the payout information has not been received (S1108: NO), the terminal CPU 1071 stands-by until it receives the payout information.

Next, at S1109, the terminal CPU 1071 determines whether the payout with respect to the current dice game is to be paid out, based on the payout information currently received. The cases where a payout is paid out are as follows: a case that the spots on the rolled dice 1040 satisfy the winning condition of the bet area 1035, when the player has made a bet on a bet area 1035; and a case that any bet area 1035 from amongst the bet areas 1035 forming the intermediate area 1042 or 1043 satisfies the winning condition thereof, when the player has made a bet on an intermediate area 1042 or 1043.

If it is determined that the payout for the current dice game is to be paid out (S1109: YES), the terminal CPU 1071 executes a payout process (S1110). Alternatively, if it is determined that the payout for the current dice game is not to be paid out (S1109: NO), the terminal CPU 1071 terminates the dice game execution process program without executing the payout process (S1110).

After shifting to S1110, the terminal CPU 1071 executes a payout process. In this payout process (S1110), the terminal CPU 1071 awards to the player a payout in the current dice game based on the payout information. Specifically, the terminal CPU 1071 adds the payout amount calculated in a later-described payout amount calculation process (S1024) to the credit amount owned by the player. The payout amount can also be awarded in the form of medals which are paid out from the cash out port 1009. Once the payout process ends, the terminal CPU 1071 ends the dice game execution process program in the terminal 1005.

Once execution of the dice game execution process program ends, the terminal CPU 1071 restarts execution of the dice game execution process program. Specifically, the terminal CPU 1071 can repeatedly execute the dice game execution process program while power is being supplied to the dice gaming machine 1001.

Next, the payout amount determination process program to be executed by the CPU 1051 in the payout amount determination process (S1009) will be described in detail while referring to the drawings. FIG. 26 is a flow chart of the payout amount determination process program.

In the dice game execution process program of the main control unit 1050, after shifting to the payout amount determination process (S1009), the CPU 1051 executes a winning bet area identification process. In the winning bet area identification process (S1021), the CPU 1051 identifies the winning bet area based on the rolling result information and the winning condition set for each bet area 1035. The winning bet area is the bet area 1035 whose specified winning condition is satisfied by the spots on the stopped dice 1040. As was described earlier, the rolling result information shows the spots on the three stopped dice 1040 which have been identified by the rolling result detection unit 1015. Accordingly, the CPU 1051 identifies the winning bet area based on the rolling result information and the winning condition of each bet area 1035. After identifying the winning bet area, the CPU 1051 shifts the process to S1022.

After shifting to S1022, the CPU 1051 judges whether or not any of the bets is a winning bet. The winning bet refers to the gaming values bet on the winning bet area identified in the winning bet area identification process (S1021), or the gaming values bet on the intermediate area 1042 or 1043 formed by bet areas 1035 including the winning bet area (hereinafter referred to as winning intermediate area). More specifically, the CPU 1051 carries out the judgment process at S1022 based on the bet information of each terminal 1005 stored in the RAM 1053. If a winning bet has been made (S1022: YES), the CPU 1051 shifts the process to S1023.

Alternatively, if none of the bets are winning bets (S1022: NO), the CPU 1051 sets the payout amount at each terminal 1005 to "0". Thereafter, the CPU 1051 ends the payout amount determination process program. Here, the case that none of the bets are winning bets includes the case that no bets for gaming values are made with respect to the bet areas 1035 and the case that all gaming values are bet with respect to a bet area 1035 other than the winning bet area, or an intermediate area 1042 or 1043 other than the winning intermediate area.

At S1023, the CPU 1051 reads the base payout magnification ratio for the winning bet area and the intermediate area payout magnification ratio of the winning intermediate area from the payout table stored in ROM 1052. The payout table stores base payout magnification ratios for all bet areas 1035 provided on the betting boards 1030A and 1030B, being associated with the respective bet areas 1035. In addition, intermediate area payout magnification ratios for all the first intermediate areas 1042 and the second intermediate areas 1043 provided respectively on the betting boards 1030A and 1030B are stored, being associated with the respective intermediate areas 1042 and 1043.

Shifting to S1024, the CPU 1051 executes a payout amount calculation process. In the payout amount calculation process (S1024), the CPU 1051 calculates payout amount with respect to the current game for all terminals 1005. Specifically, the CPU 1051 calculates the payout amount for each terminal 1005 with respect to the current game through carrying out the following processes at every terminal 1005.

Specifically, the CPU 1051 calculates the payout amount related to the winning bet area through multiplying the bet amount on the winning bet area by the "base payout magnification ratio" with respect to the winning bet area. Also, the CPU 1051 calculates the payout amount related to the winning intermediate area through multiplying the bet amount on the winning intermediate area by the "intermediate area payout magnification ratio" with respect to the winning intermediate area. If bets for gaming values are made with respect to a plurality of winning bet areas or a plurality of intermediate areas, the CPU 1051 calculates a payout amount corresponding to each winning bet area and each winning intermediate area.

The CPU 1051 sets the payout amounts corresponding to the bet areas other than the winning bet area to "0". Similarly, the payout amounts corresponding to the intermediate areas other than the winning intermediate area are set to "0". The CPU 1051 adds up the payout amounts of the bet areas calculated through the processes described above, for each terminal 1005. As a result, the CPU 1051 calculates the resultant payout amount of each terminal 1005. The CPU 1051 stores the information showing the payout amount at each terminal 1005 in the RAM 1053. The information showing the payout amount of each terminal 1005 makes up the payout information of each terminal 1005. Then, the CPU 1051 ends the payout amount determination process program. As shown in FIG. 25, once the payout amount determination process (S1009) ends, the CPU 1051 shifts the process to the payout information transmission process (S1010).

As was described earlier, in the payout information transmission process (S1010), the CPU 1051 respectively transmits the payout information showing the payout amount thus calculated from the main control unit 1050 to every terminal 1005. In each terminal 1005, the terminal CPU 1071 executes the payout process (S1110) based on the payout information thus received.

As described above, the dice gaming machine 1001 according to the second embodiment accepts a bet on a bet area 1035 and a bet on an intermediate area 1042,43 between/among a plurality of bet areas 1035 (S1103). According to the operation of the CHANGE button 1039, the position pattern of bet areas 1035 is switched between the first position pattern and the second position pattern (S1105). After ending the bet acceptance, it starts rolling dice (S1007). After the rolling of the dice has been stopped, the dice gaming machine 1001 identifies a winning bet area based on the dice rolling result (S1021). A payout amount for each terminal is calculated based on the identified winning bet area, the bet area 1035 or the intermediate area 1042 or 1043 on which the bet is accepted, and a payout magnification ratio set for the bet area 1035 or the intermediate area 1042 or 1043 (S1024). Thereby, the dice gaming machine 1001 enables a player to grasp how the bet areas associated with the same type of winning condition are positioned on the betting board. And it allows players want to play by using the layout of conventional bet areas to a desired betting board. Accordingly, it enables a player to execute a bet operation quickly and accurately. And it can allow players to enjoy much wider variety of gaming elements.

The present invention is not limited to the embodiments described above, but various improvements and modifications can be made thereto without departing from the spirit of the present invention.

For instance, in the second embodiment, a bet is accepted only on a first intermediate area 1042 and a second intermediate area 1043 formed by bet areas 1035 related to the same type of winning condition (e.g., total bet areas 1035F); however, a bet may be accepted on an intermediate area 1044 formed by bet areas related to different types of winning conditions (e.g., a total bet area 1035F and a combination bet area 1035G). Additionally, a bet may be accepted on an intermediate area formed by more than two bet areas 1035.

On the betting board 1030A (refer to FIG. 19), the position of bet areas 1035 each associated with a same type of winning condition may be changed at random. In such a case, an intermediate area payout magnification ratio set at an intermediate area 1042 or 1043 changes according to the position pattern of the bet areas 1035.

The present invention can also be realized as a gaming method for executing the above-described processes. Further, the present invention can also be realized as a program for causing a computer to execute such gaming method, and a recording medium onto which such program is recorded.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A dice gaming machine comprising:

a dice box in which a plurality of dice are rolled and stopped;

a plurality of terminals each having a betting board having a plurality of bet areas each associated with a winning condition based on spots on the plurality of dice stopped and with a predetermined payout magnification ratio and a plurality of intermediate areas, the plurality of terminals each accepting an input by a player, wherein each of the plurality of intermediate areas is arranged between or among plural adjacent bet areas, and each of the plurality of bet areas is enclosed with a border, and each intermediate area is distinguished by borders of the plural adjacent bet areas; and a processor executing processes of:

(a) accepting a bet of a gaming value on any one or more of the plurality of intermediate areas;

(b) rolling and stopping the plurality of dice;

(c) identifying a winning bet area among from the plurality of bet areas which satisfies the winning condition based on spots on the plurality of dice stopped; and (d) awarding a prize based on an amount of the gaming value bet at a winning intermediate area adjacent to the winning bet area identified at the process (c) and a payout magnification ratio set for the winning intermediate area, wherein the processor sets the payout magnification ratio for the winning intermediate area so that an expected value (A) of the winning intermediate area always lies between a maximum value and a minimum value and the maximum value and the minimum value respectively correspond to an expected value (B) directed to an adjacent bet area (x) and an expected value (C) directed to an adjacent bet area (y), the adjacent bet area (x) and the adjacent bet area (y) being adjacent to the winning intermediate area, when the expected value (B) is higher than the expected value (C), and wherein the expected value (A) is a value obtained by multiplying a winning probability of the winning intermediate area, a payout magnification ratio set for the winning intermediate area and a unit of gaming value, the expected value (B) is a value obtained by multiplying a winning probability of the adjacent bet area (x), a payout magnification ratio set for the adjacent bet area (x) and the unit of gaming value, and the expected value (C) is a value obtained by multiplying a winning probability of the adjacent bet area (y), a payout magnification ratio set for the adjacent bet area (y) and the unit of gaming value.

2. The dice gaming machine according to claim 1, wherein the processor sets the payout magnification ratio for the winning intermediate area so as to satisfy a condition such that, in case (bet I) and (bet II) as below are placed concurrently, an expected value (D) obtained with the (bet I) is higher than a comprehensive expected value (E) obtained with the (bet II):

(bet I) a certain amount of gaming value is bet on the winning intermediate area, (bet II) the certain amount of gaming value divided by number of plural adjacent bet areas adjacent to the winning intermediate area is equally bet on all the plural adjacent bet areas adjacent to the winning intermediate area, and wherein the expected value (D) is a value obtained by multiplying the winning probability of the winning intermediate area, the payout magnification ratio set for the winning intermediate area and the certain amount of gaming value, the comprehensive expected value (E) is a sum of expected values directed to the plural adjacent bet areas adjacent to the winning intermediate area, and an expected value directed to one of the plural adjacent bet areas is a value obtained by multiplying a winning probability of the one of the plural adjacent bet areas, a payout magnification ratio set for the one of the plural adjacent bet areas and the certain amount of gaming value.

3. A dice gaming machine comprising:

a dice box in which a plurality of dice are rolled and stopped;

a plurality of terminals each having a betting board having a plurality of bet areas each associated with a winning condition based on spots on the plurality of dice stopped and with a predetermined payout magnification ratio and a plurality of intermediate areas, the plurality of terminals each accepting an input by a player, wherein each of the plurality of intermediate areas is arranged between or among plural adjacent bet areas, and each of the plurality of bet areas is enclosed with a border, and each intermediate area is distinguished by borders of the plural adjacent bet areas; and a processor executing processes of:

(a) positioning the plurality of bet areas making up the betting board each of the plurality of terminals wherein a plurality of bet areas each associated with a same type of winning condition are in a matrix state;

(b) accepting a bet of a gaming value on any one or more of the plurality of intermediate areas at any of the plurality of the terminals;

(c) rolling and stopping the plurality of dice;

(d) identifying a winning bet area among from the plurality of bet areas which satisfies the winning condition based on spots on the plurality of dice stopped; and (e) awarding a prize based on an amount of the gaming value bet at a winning intermediate area adjacent to the winning bet area identified at the process (d) and a payout magnification ration set for the winning intermediate area, wherein the processor sets the payout magnification ratio for the winning intermediate area so that an expected value (A) of the winning intermediate area always lies between a maximum value and a minimum value and the maximum value and the minimum value respectively correspond to an expected value (B) directed to an adjacent bet area (x) and an expected value (C) directed to an adjacent bet area (y), the adjacent bet area (x) and the adjacent bet area (y) being adjacent to the winning intermediate area, when the expected value (B) is higher than the expected value (C), and wherein the expected value (A) is a value obtained by multiplying a winning probability of the winning intermediate area, a payout magnification ratio set for the winning intermediate area and a unit of gaming value, the expected value (B) is a value obtained by multiplying a winning probability of the adjacent bet area (x), a payout magnification ratio set for the adjacent bet area (x) and the unit of gaming value, and the expected value (C) is a value obtained by multiplying a winning probability of the adjacent bet area (y), a payout magnification ratio set for the adjacent bet area (y) and the unit of gaming value.

4. The dice gaming machine according to claim 3, wherein the processor sets the payout magnification ratio for the winning intermediate area so as to satisfy a condition such that, in case (bet I) and (bet II) as below are placed concurrently, an expected value (D) obtained with the (bet I) is higher than a comprehensive expected value (E) obtained with the (bet II):

(bet I) a certain amount of gaming value is bet on the winning intermediate area, (bet II) the certain amount of gaming value divided by number of plural adjacent bet areas adjacent to the winning intermediate area is equally bet on all the plural adjacent bet areas adjacent to the winning intermediate area, and wherein the expected value (D) is a value obtained by multiplying the winning probability of the winning intermediate area, the payout magnification ratio set for the winning intermediate area and the certain amount of gaming value and the comprehensive expected value (E) is a sum of expected values directed to the plural adjacent bet areas adjacent to the winning intermediate area, and an expected value directed to one of the plural adjacent bet areas is a value obtained by multiplying a winning probability of one of the plural adjacent bet areas adjacent to the winning intermediate area, a payout magnification ratio set for the one of the plural adjacent bet areas and the certain amount of gaming value.

5. A dice gaming machine comprising:

a dice box in which a plurality of dice are rolled and stopped;

a plurality of terminals each having a betting board having a plurality of bet areas each associated with a winning condition based on spots on the plurality of dice stopped and with a predetermined payout magnification ratio and a plurality of intermediate areas, the plurality of terminals each accepting an input by a player, wherein each of the plurality of intermediate areas is arranged between or among plural adjacent bet areas, and each of the plurality of bet areas is enclosed with a border, and each intermediate area is distinguished by borders of the plural adjacent bet areas;

an operation unit installed in each of the plurality of terminals; and a processor executing processes of:

(a) changing a position pattern of the plurality of bet areas making up the betting board of each of the plurality of terminals, between a first position pattern in which a plurality of bet areas each associated with a same type of winning condition are in a matrix state, and a second position pattern different from the first position pattern;

(b) accepting a bet of a gaming value on any one or more of the plurality of intermediate areas at any of the plurality of the terminals;

(c) rolling and stopping the plurality of dice;

(d) identifying a winning bet area among from the plurality of bet areas which satisfies the winning condition based on spots on the plurality of dice stopped; and (e) awarding a prize based on an amount of the gaming value bet at a winning intermediate area adjacent to the winning bet area identified at the process (d) and a payout magnification ratio set for the winning intermediate area wherein the processor sets the payout magnification ratio for the winning intermediate area so that an expected value (A) of the winning intermediate area always lies between a maximum value and a minimum value, and the maximum value and the minimum value respectively correspond to an expected value (B) directed to an adjacent bet area (x) and an expected value (C) directed to an adjacent bet area (y), the adjacent bet area (x) and the adjacent bet area (y) being adjacent to the winning intermediate area, when the expected value (B) is higher than the expected value (C), and wherein the expected value (A) is a value obtained by multiplying a winning probability of the winning intermediate area, a payout magnification ratio set for the winning intermediate area and a unit of gaming value, the expected value (B) is a value obtained by multiplying a winning probability of the adjacent bet area (x), a payout magnification ratio set for the adjacent bet area (x) and the unit of gaming value, and the expected value (C) is a value obtained by multiplying a winning probability of the adjacent bet area (y), a payout magnification ratio set for the adjacent bet area (y) and the unit of gaming value.

6. The dice gaming machine according to claim 5, wherein the processor sets the payout magnification ratio for the winning intermediate area so as to satisfy a condition such that, in case (bet I) and (bet II) as below are placed concurrently, an expected value1 (D) obtained with the (bet I) is higher than a comprehensive expected value (E) obtained with the (bet II):

(bet I) a certain amount of gaming value is bet on the winning intermediate area, (bet II) the certain amount of gaming value divided by number of plural adjacent bet areas adjacent to the winning intermediate area is equally bet on all the plural adjacent bet areas adjacent to the winning intermediate area, and wherein the expected value (D) is a value obtained by multiplying the winning probability of the winning intermediate area, the payout magnification ratio set for the winning intermediate area and the certain amount of gaming value, the comprehensive expected value (E) is a sum of expected values directed to the plural adjacent bet areas adjacent to the winning intermediate area, and an expected value directed to one of the plural adjacent bet areas is a value obtained by multiplying a winning probability of one of the plural adjacent bet areas adjacent to the winning intermediate area, a payout magnification ratio set for the one of the plural adjacent bet areas and the certain amount of gaming value.

* * * * *